US006597888B1

(12) United States Patent
Abe et al.

(10) Patent No.: US 6,597,888 B1
(45) Date of Patent: Jul. 22, 2003

(54) IMAGE HEATING APPARATUS WITH HOLDING A DRIVING MEMBERS FOR BELT OUTSIDE NIP PORTION

(75) Inventors: Atsuyoshi Abe, Susono (JP); Masahiro Suzuki, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/660,445

(22) Filed: Sep. 12, 2000

(30) Foreign Application Priority Data

Sep. 13, 1999 (JP) ..... 11-258788

(51) Int. Cl.[7] ..... G03G 15/20
(52) U.S. Cl. ..... 399/329
(58) Field of Search ..... 399/320, 328, 399/329, 333

(56) References Cited

U.S. PATENT DOCUMENTS

| | | | | |
|---|---|---|---|---|
| 5,083,168 A | | 1/1992 | Kusaka et al. | |
| 5,149,941 A | | 9/1992 | Hirabayashi et al. | 219/216 |
| 5,210,579 A | | 5/1993 | Setoriyama et al. | |
| 5,235,395 A | * | 8/1993 | Ishiwata | 399/329 |
| 5,499,087 A | * | 3/1996 | Hiraoka et al. | 399/329 |
| 5,525,775 A | | 6/1996 | Setoriyama et al. | 219/216 |
| 5,534,987 A | | 7/1996 | Ohtsuka et al. | |
| 5,552,582 A | | 9/1996 | Abe et al. | 219/619 |
| 5,552,874 A | | 9/1996 | Ohtsuka et al. | |
| 5,568,240 A | | 10/1996 | Ohtsuka | |
| 5,801,359 A | * | 9/1998 | Mano et al. | 399/329 X |
| 5,852,763 A | | 12/1998 | Okuda et al. | 399/329 |
| 6,078,780 A | | 6/2000 | Abe et al. | 399/328 |
| 6,091,926 A | * | 7/2000 | Yamada | 399/329 |

FOREIGN PATENT DOCUMENTS

| | | |
|---|---|---|
| JP | 63-313182 | 12/1988 |
| JP | 2-157878 | 6/1990 |
| JP | 4-44075 | 2/1992 |
| JP | 4-204980 | 7/1992 |

* cited by examiner

*Primary Examiner*—Sandra Brase
(74) *Attorney, Agent, or Firm*—Fitzpatrick, Cella, Harper & Scinto

(57) ABSTRACT

The present invention provides an image heating apparatus, which has a movable endless belt, a support member for supporting the belt at an inside of the belt, wherein the belt slides relative to the support member and an image on a recording material is heated with heat from the belt, a holding member for holding the belt at an inside of the belt and movable together with the belt, and a driving member opposing to the holding member via the belt and driving the belt.

18 Claims, 14 Drawing Sheets

IMAGE HEATING APPARATUS WITH HOLDING A DRIVING MEMBERS FOR BELT OUTSIDE NIP PORTION

BACKGROUND OF THE INVENTION

1. Field of the Invention

The present invention relates to an image heating apparatus which is applied to an image forming apparatus such as a copying machine or a printer, and more specifically an apparatus which utilizes an endless belt.

2. Related Background Art

For convenience, description will be made taking as an example an image heating apparatus (fixing apparatus) which is used in an image forming apparatus such as a copying machine or a printer for heating a toner image and fixing the toner image to a recording material.

A heating roller type image forming apparatus is widely used as a fixing apparatus which heats and fixes, as an image permanently fixed on a surface of a recording material, an unfixed image (toner image) of image data which is formed and born (carried) in a transfer mode or a direct mode on a recording material (transfer material sheet, Electrofax sheet, electrostatic recording paper, OHP sheet, printing paper, format paper or the like) by adequate image forming process means such as an electrophotographic process, an electrographic recording process or a magnetic recording process.

A heater contact film heating type apparatus has recently been put to practical use from viewpoints of quick start and energy saving. Furthermore, an electromagnetic induction heating type apparatus has been also proposed.

a) Heating Roller Type Fixing Apparatus

A heating roller type fixing apparatus has a basic configuration of a pair of pressure contact rollers consisting of a fixing roller (heating roller) and a pressurizing roller, and functions to introduce a recording material on which an unfixed toner image to be fixed is formed and carried into a fixing nip section (heating nip section) which is a mutual contact portion between the above described pair of rollers, sandwich and carry the recording material, and heat the unfixed toner image and fix the image to a surface of the recording material with heat of the fixing roller and a pressurizing force of the fixing nip section.

The fixing roller is generally composed of a hollow metal roller of aluminum as a base body (core metal) and a halogen lamp disposed in a hollow space as a heat source and is heated by heat generated by the halogen lamp, and power supply to the halogen lamp is controlled so as to maintain an outer circumferential surface of the fixing roller at a predetermined fixing temperature.

In case of a fixing apparatus of an image forming apparatus for forming an image in full colors which must have a capability to mix colors by sufficiently heating and melting four toner image layers at maximum and allows fixing to be improper due to insufficient heating down to an interface between a recording material and a toner layer in particular, an elastic layer of rubber is disposed so that a core metal of a fixing roller has a large heat capacity and a toner image is melted uniformly in a condition wrapped in an outer circumference of the core metal, and the toner image is heated by way of the elastic layer of rubber. Further, a certain fixing apparatus is configured to use a heat source disposed also in a pressurizing roller so that the pressurizing roller is also heated and kept at a controlled temperature.

b) Heater Contact Film Heating Type Fixing Apparatus

Heater contact film heating type fixing apparatuses are proposed, for example, by Japanese Patent Application Laid-Open No. 63-313182, No. 2-157878, No. 4-44075 and No. 4-204980.

Concretely speaking, a heater contact film heating type fixing apparatus is configured to form a fixing nip section generally by sandwiching a heat resistant film (fixing film or fixing belt) between a ceramic heater used as a heating body and a pressurizing roller used as a pressurizing member, introduce a recording material on which an unfixed toner image to be fixed is formed and carried between the fixing film and the pressurizing roller in the above described fixing nip section, and sandwich and carry the recording material together with the fixing film, thereby imparting heat of the ceramic heater to the recording material by way of the fixing film in the fixing nip section and fixing the unfixed toner image to a surface of the recording material with heat and a pressing force of the fixing nip section (portion).

This film heating type fixing apparatus permits composing an on-demand type apparatus using members having low heat capacities as the ceramic heater and the fixing film, and requires power supply to the ceramic heater used as a heat source to set it in a condition heated to a predetermined fixing temperature only during execution of image formation by an image forming apparatus, thereby providing merits to shorten a wait time from a power on time of the image forming apparatus till a condition ready for the execution of image formation (a quick start property) and remarkably lower power consumption in a standby condition (power saving property).

c) Electromagnetic Induction Heating Type Fixing Apparatus

Japanese Utility Model Application Laid-Open No. 51-109739 discloses an induction heating fixing apparatus which induces an electric current in a fixing roller with a magnetic flux, thereby heating the fixing roller with Joule heat. This fixing apparatus is capable of directly heating the fixing roller by utilizing generation of an induced current and providing a fixing process with an efficiency higher than that of the heating roller type fixing apparatus which uses a halogen lamp as a heat source.

A high efficiency fixing apparatus has been contrived by bringing an excitation coil nearer a fixing roller used as a heat generating body to obtain a fixing energy at a high density or concentrating a distribution of an alternating magnetic flux of an excitation coil in the vicinity of a fixing nip section.

FIG. 16 shows a schematic configuration of an example of electromagnetic induction heating type fixing apparatus which has an efficiency enhanced by concentrating a distribution of an alternating magnetic flux of an excitation coil on a fixing nip.

Reference numeral 10 denotes a fixing belt (fixing film) in a form of an endless (cylindrical) belt which has electromagnetic induction heat generating layers (a layer of an electrically conductive material, a layer of a magnetic material and a layer of resistor material), and is configured as a heating rotating body generating heat by electromagnetic induction.

Reference numeral 16 denotes a belt guide member (film guide member) in a form of a conduit which has a cross section nearly of a semicircle and the endless belt 10 is loosely fitted outside the belt guide member 16.

Reference numeral 15 denotes magnetic field producing means which is disposed inside the belt guide member 16, and consists of excitation coils 18 and an E shaped magnetic core (core member) 17.

Reference numeral 30 denotes an elastic pressurizing roller which is pressed under a predetermined force to a bottom surface of the belt guide member 16 with the fixing belt 10 interposed so as to form a fixing nip portion N having a predetermined width. The magnetic core 17 of the above described magnetic field producing means 15 is disposed at a location corresponding to the fixing nip portion N.

The pressurizing roller 30 is rotatingly driven by driving means M counterclockwise as indicated by an arrow. When the pressurizing roller 30 is rotatingly driven, a frictional force between the pressurizing roller 30 and an outside surface of the fixing belt 10 exerts a rotating force to the fixing belt 10 in the fixing nip portion N, whereby the fixing belt 10 is set in a condition where it rotates clockwise along an outer circumference of the belt guide member 16 at a circumferential speed nearly corresponding to a circumferential rotating speed of the pressurizing roller 30 while sliding in close contact with a bottom surface of the belt guide member 16 in the fixing nip portion N (pressurizing roller driving type).

The belt guide member 16 functions to apply a pressure to the fixing nip portion N, support the excitation coil 18 and the magnetic core 17 which are used as the magnetic field producing means 15 and the fixing belt 10, and stabilize carriage of the fixing belt 10 during its rotation. The belt guide member 16 is made of an insulating material which does not hinder transmission of a magnetic flux and is bearable of a heavy load.

The excitation coil 18 produces an alternating magnetic flux with an alternating current supplied from an excitation circuit (not shown). The alternating magnetic flux is distributed concentratedly on the fixing nip portion N by the E shaped magnetic core 17 corresponding to the location of the fixing nip portion N and produces an eddy current in the electromagnetic induction heat generating layers of the fixing belt 10 in the fixing nip portion N. This eddy current generates Joule heat by a resistivity of the electromagnetic induction heat generating layers.

This electromagnetic induction heat of the fixing belt 10 is generated concentratedly in the fixing nip portion N in which the alternating magnetic flux is distributed concentratedly and heats the fixing nip portion N with a high efficiency.

A temperature in the fixing nip portion N is controlled so as to be kept at a predetermined level with a temperature control system including temperature detecting means (not shown) which controls a current supplied to the excitation coil 18.

In such a condition where the pressurizing roller 30 is rotatingly driven, the endless fixing belt 10 is rotating along the outer circumference of the belt guide member 16, the fixing belt 10 generates the electromagnetic induction heat with the current supplied from the excitation circuit to the excitation coil 18 and the fixing nip portion N is heated and controlled to the predetermined temperature, a recording material P which is carried from image forming means (not shown) and on which an unfixed toner image t is formed is introduced between the fixing belt 10 and the pressurizing roller 30 in the fixing nip portion N with an image surface set upside, that is, opposed to a surface of the fixing belt, and sandwiched and carried together with the fixing belt 10 through the fixing nip portion N with the image surface kept in close contact with an outside surface of the fixing belt 10 in the fixing nip portion N. At a process where the recording material P is sandwiched and carried together with the fixing belt 10 through the fixing nip portion N, the unfixed toner image on the recording material P is heated and fixed by the electromagnetic induction heat of the fixing belt 10. Upon having passed through the fixing nip portion N, the recording material P is separated from the outside surface of the rotating fixing belt 10, thereafter being discharged and carried.

In a case where the endless fixing belt 10 is driven with the pressurizing roller 30 as in the pressurizing roller driving type fixing apparatus as in the example described above, the recording material P may slip and cannot be carried smoothly when slide resistance between the fixing belt 10 and the belt guide member 16 is higher than the frictional resistance between the pressurizing roller 30 and the fixing belt 10 or when frictional resistance between the pressuring roller 30 and the recording material P is lower than the slide resistance between the fixing belt 10 and the belt guide member 16.

Furthermore, there is a problem that thermal expansion of the elastic layer of the pressurizing roller 30 which functions as a driving roller causes a change of an outside diameter of the pressurizing roller 30, thereby making a carrying speed of the recording material P not constant.

Furthermore, there is another problem that the belt is heavily loaded and is liable to be deteriorated since the belt is driven only at a location which is in slide contact with the guide member.

SUMMARY OF THE INVENTION

An object of the present invention is to provide an image heating apparatus which lessens deterioration of a belt to be caused due to driving.

Another object of the present invention is to provide an image heating apparatus which prevents a belt from slipping.

Still another object of the present invention is to provide an image heating apparatus which carries a belt stably.

Still another object of the present invention is to provide an image heating apparatus comprising a movable endless belt, a support member for supporting the belt at an inside of the belt, a holding member for holding the belt at an inside of the belt and being movable together with the belt, and a driving member opposing to the holding member via the belt and driving the belt, wherein the belt slides relative to the support member and an image on a recording material is heated with heat from the belt.

Further another object of the present invention will be apparent from description that follows.

DETAILED DESCRIPTION OF THE PREFERRED EMBODIMENTS

Figure 15:
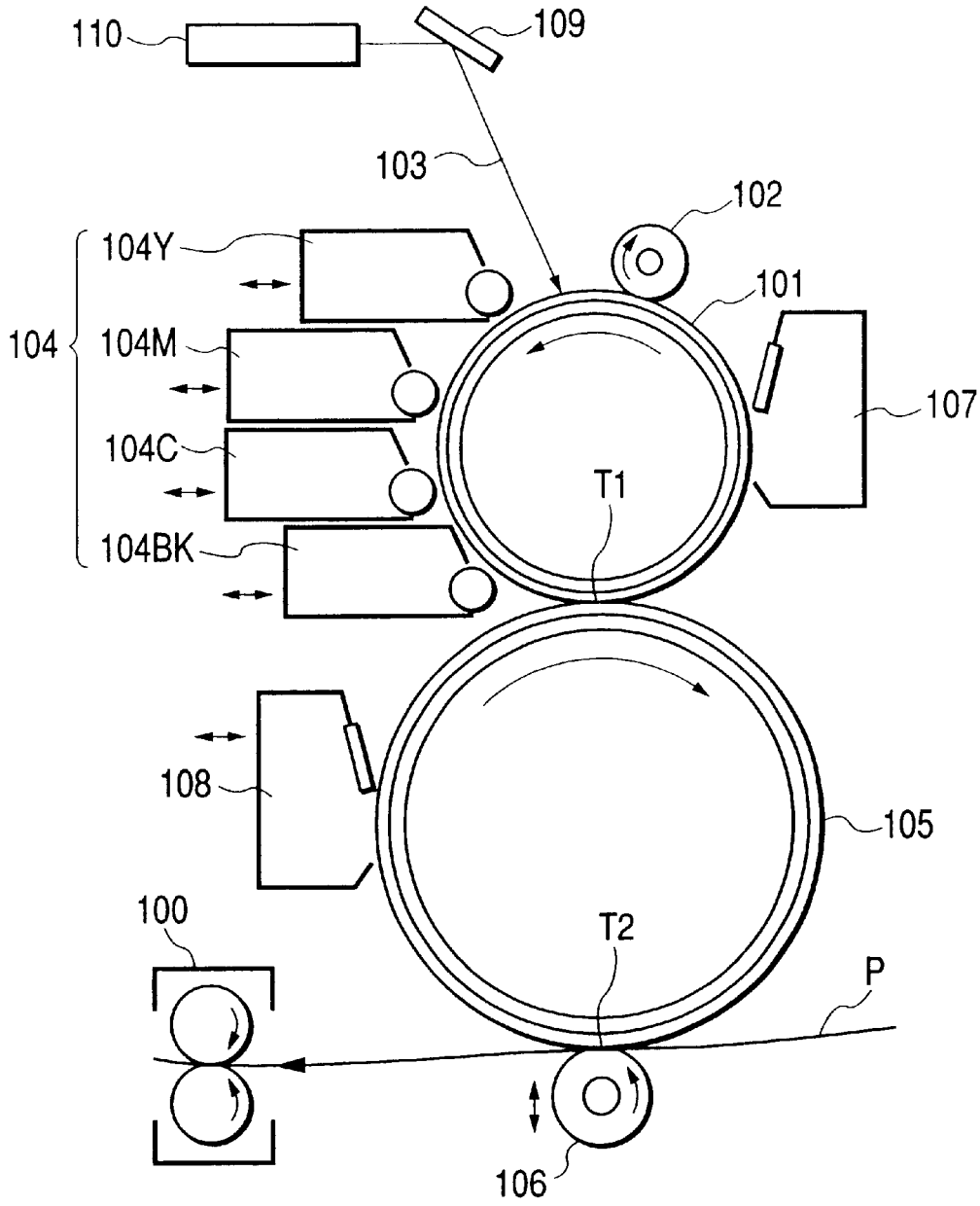
FIG. 15 is a diagram showing an image forming apparatus to which the present invention is applicable.

Now, preferred embodiments of the present invention will be described with reference to the accompanying drawings. First, an image forming apparatus to which the present invention is applicable will be described with reference to FIG. 15.

The image forming apparatus of this embodiment is a color laser printer which utilizes an electrophotographic process.

Reference numeral 101 denotes a photosensitive drum which is made of an organic photosensitive substance, an amorphous silicon photosensitive substance, as an image bearing body and rotatingly driven counterclockwise as indicated by an arrow at a predetermined process speed (circumferential speed).

At a rotating process, the photosensitive drum 101 is subjected to a uniform charging treatment at a predetermined polarity and a predetermined potential by a charging device 102 such as an electrifying roller.

Then, a surface which has been subjected to the charging treatment is subjected to a scanning exposure treatment of image data by a laser beam 103 output from a laser optical box (laser scanner) 110. The laser optical box 110 scans and exposes the surface of the photosensitive drum 101 by outputting the laser beam 103 which is modulated (turned on and off) in correspondence to time series electric digital signals supplied from an image signal generating device such as an image reading device (not-shown). Accordingly, an electrostatic latent image corresponding to the image data is formed on the surface of the photosensitive drum. Reference numeral 109 denotes a mirror which deflects the laser beam output from the laser optical box 110 to an exposure location of the photosensitive drum 101.

In a case where an image is to be formed in full colors, scanning exposure and formation of a latent image are carried out for an image of a first color separation component of a target full color image, for example, an image of an yellow component and the latent image is developed as an yellow toner image by an operation of an yellow developing device 104Y of a four-color developing apparatus 104. The yellow toner image is transferred to a surface of an intermediate transfer drum 105 in a primary transfer section T1 which is a contact section (or a vicinity section) between the photosensitive drum 101 and the intermediate transfer drum 105. After the toner image has been transferred to the surface of the intermediate transfer drum 105, the surface of the photosensitive drum 101 is cleaned by removing toner remaining after transfer with a cleaner 107.

A process cycle of the charging, scanning exposure, development, primary transfer and cleaning described above is executed consecutively for each of an image of a second color separation component (for example, an image of a magenta component developed by an operation of a magenta developing device 104M) of the target full color image, an image of a third color separation component (for example, an image of a cyan component developed by a cyan developing device 104C) and an image of a fourth color separation component (for example, an image of a black component developed by a black developing device 104K), whereby an yellow toner image, a magenta toner image, a cyan toner image and a black toner image are consecutively overlapped and transferred to the surface of the intermediate transfer drum 105 to form a color toner image corresponding to the target full color image.

The intermediate transfer drum 105 is configured by an elastic layer having medium resistance and a surface layer having high resistance which are disposed over a metal drum, kept in contact with or near the photosensitive drum 101 and rotatingly driven clockwise as indicated by an arrow at the same circumferential speed as that of the photosensitive drum 101, thereby giving a bias potential to the metal drum of the intermediate transfer drum 105 and transferring the toner image from the photosensitive drum 101 to the above described intermediate transfer drum 105 by a difference in potential between the metal drum and the photosensitive drum 101.

The color toner image formed on the surface of the above described intermediate transfer drum 105 is transferred to a surface of a recording material P which is fed into a secondary transfer portion T2 at a predetermined timing from a paper feeding section (not shown) in the secondary transfer portion T2 which is a contact nip section between the above described intermediate transfer drum 105 and a transfer roller 106. The transfer roller 106 consecutively transfers a composite color toner image in four colors collectively from the surface of the intermediate transfer drum 105 to the recording material P in a moving direction of the recording material by supplying electric charges having a polarity reverse to that of the toner from a rear surface of the recording material P.

After passing through the secondary transfer portion T2, the recording material P is separated from the surface of the intermediate transfer drum 105, introduced into a fixing apparatus (image heating apparatus) 100, subjected to a heating fixing treatment of an unfixed toner image and discharged into a waste paper tray (not shown) outside the fixing apparatus. The fixing apparatus 100 is, for example, an electromagnetic induction heating type fixing apparatus. This fixing apparatus will be detailed later.

After the color toner image has been transferred to the recording material P, the intermediate transfer drum 105 is cleaned by removing adhering residues such as toner and paper powder remaining after transfer with a cleaner 108. This cleaner 108 is usually kept in a condition where it is not in contact with the intermediate transfer drum 105 but set in a condition where it is in contact with the intermediate transfer drum 105 at a process to execute the secondary transfer of the color toner image from the intermediate transfer 105 drum to the recording material P.

Furthermore, the transfer roller 106 is usually kept also in a condition where it is not in contact with the intermediate transfer drum 105 but set in a condition where it is in contact with the intermediate transfer drum 105 by way of the recording material P at a process to execute the secondary transfer of the color toner image from the intermediate transfer drum to the recording material P.

The image forming apparatus preferred as the embodiment is capable of printing a monochromatic image such as a white-black image in a mono-color print mode.

Furthermore, the image forming apparatus is also capable of operating in a two-sided (double surface) image print mode or a multiple image print mode.

In case of the two-sided image print mode, the recording material P which comes out of the fixing apparatus 100 and has an image printed on a first surface is sent once again into the secondary transfer portion T2 with a front surface and a rear surface reversed by way of a recycling carriage mechanism (not shown), subjected to toner image transfer to a second surface, and introduced once again into the fixing apparatus 100 for a fixing treatment of the toner image on two surfaces, whereby a print having images on two surfaces is output.

In case of the multiple surface image print mode, the recording material P which comes out of the fixing apparatus and has a first printed image is sent once again into the secondary transfer portion T2 with the front surface and the rear surface not reversed by way of the recycling carriage mechanism (not shown), subjected to a second toner image transfer to a surface having the first printed image and introduced once again into the fixing apparatus 100 for a fixing treatment of the second toner image, whereby a print having multiple images is output.

Figure 1:
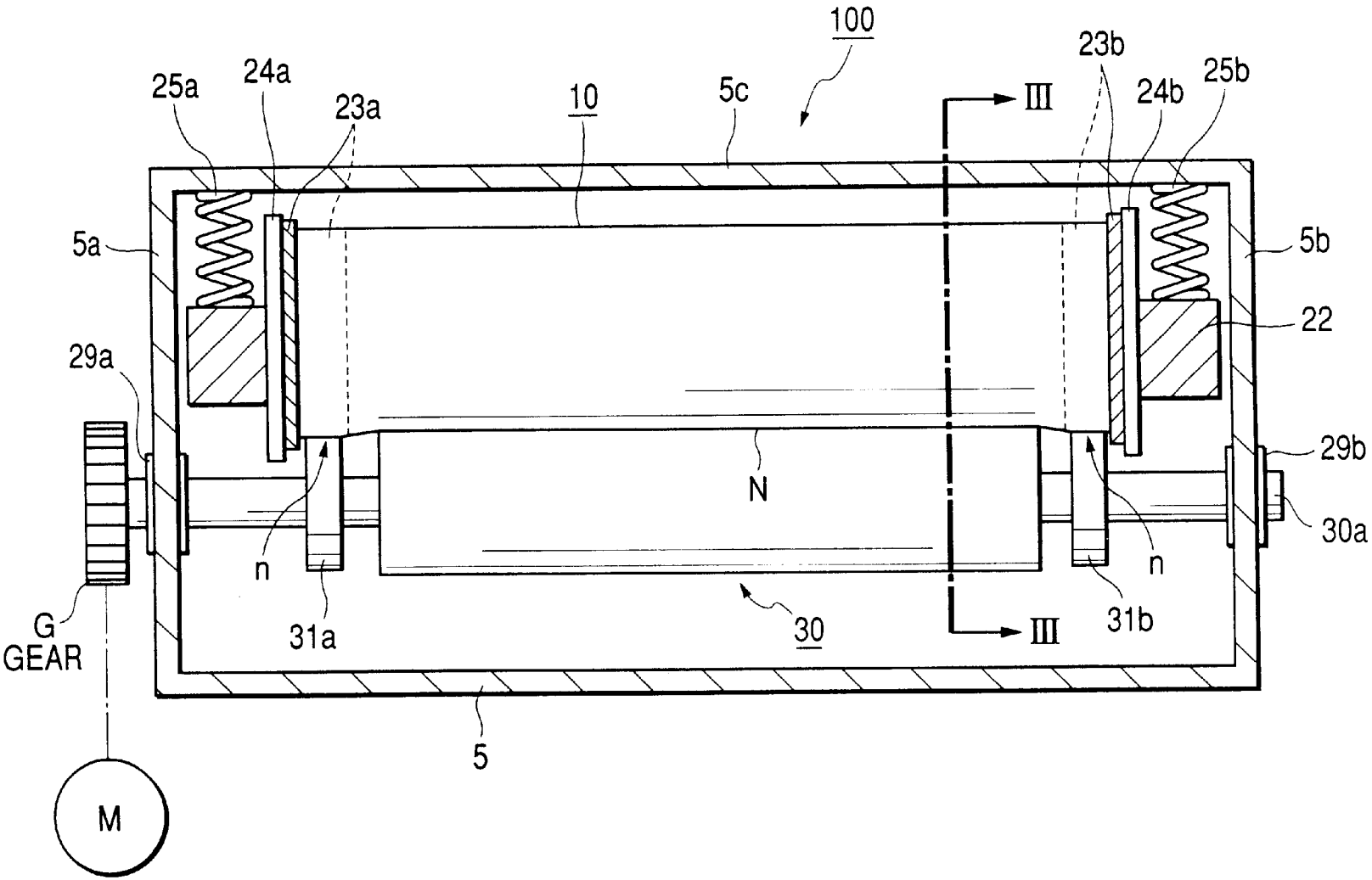
FIG. 1 is a front view of an image heating apparatus as an embodiment of the present invention.
Figure 2:
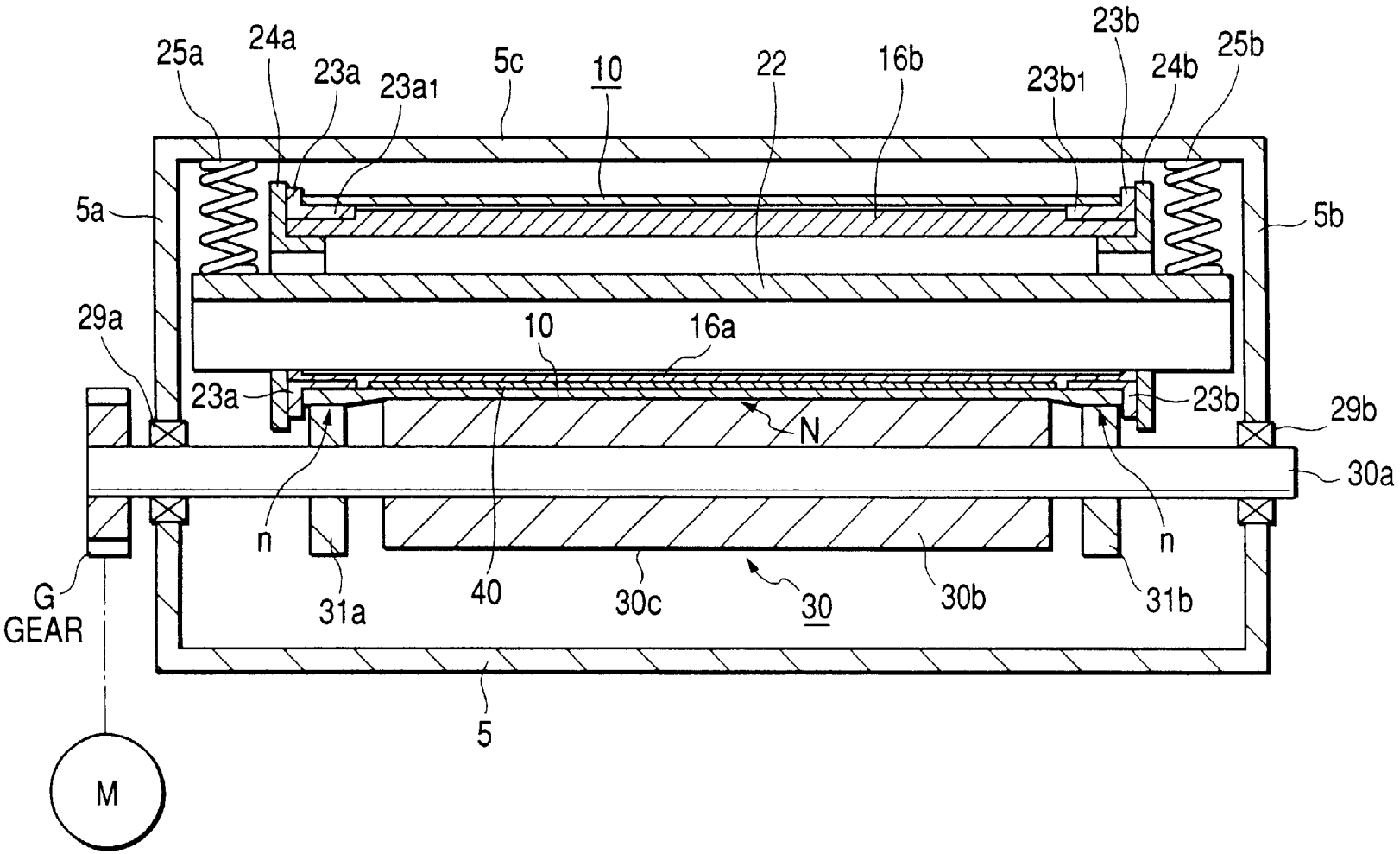
FIG. 2 is a front sectional view of the image heating apparatus.
Figure 3:
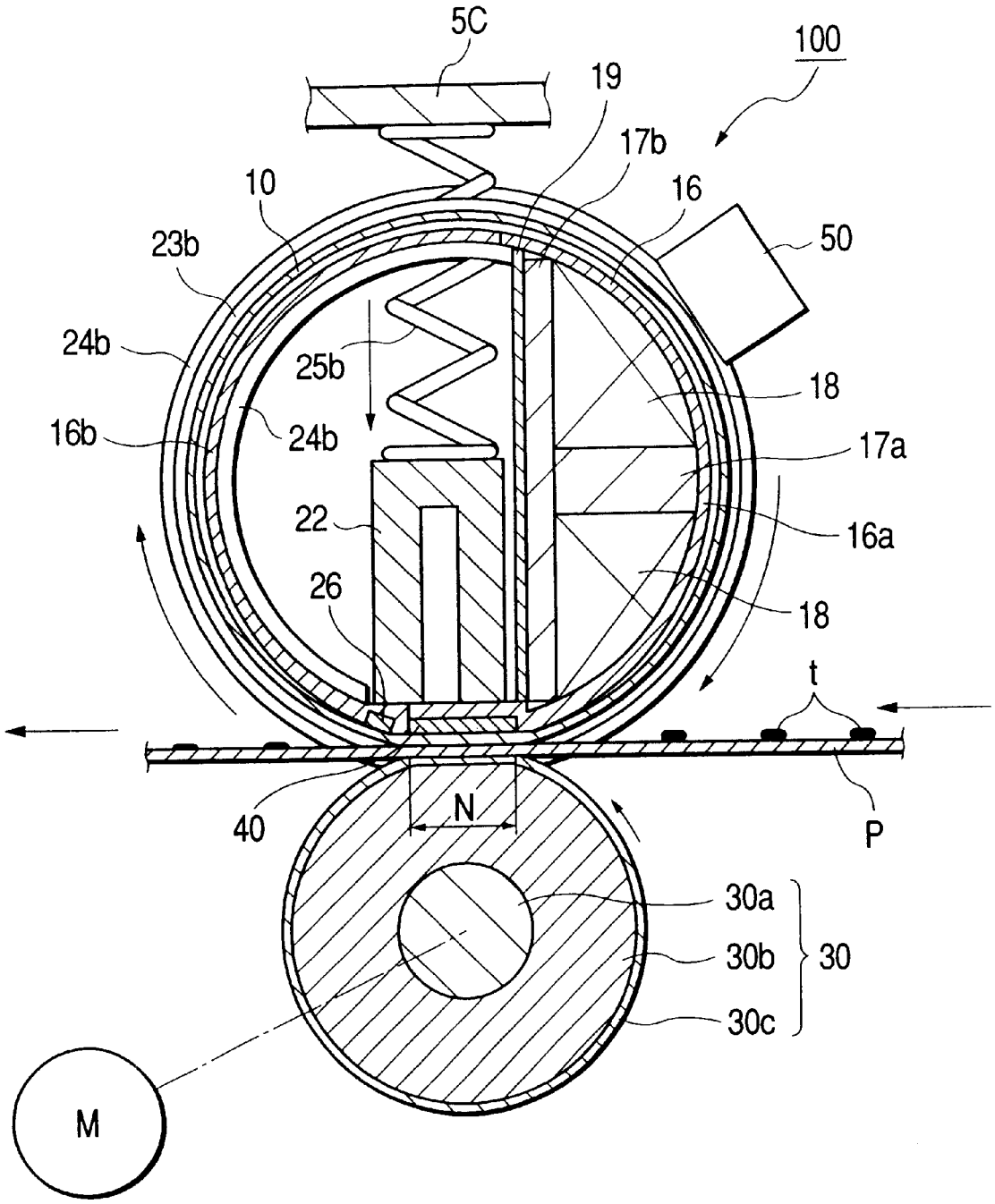
FIG. 3 is a side sectional view of the image heating apparatus.

FIGS. 1 through 3 are diagrams illustrating an image heating apparatus preferred as an embodiment of the present invention.

The heating apparatus preferred as the embodiment is a pressure rotating member driving electromagnetic induction heating type image heating fixing apparatus which uses an electromagnetic induction heat generating endless (cylindrical) fixing belt (fixing film) as a heating member.

FIG. 1 is a schematic front view of main parts of a fixing apparatus 100 preferred as the embodiment, FIG. 2 is a schematic longitudinal sectional front view of the main parts and FIG. 3 is a schematic cross sectional view taken along a III—III line in FIG. 1.

Reference numeral 10 denotes an electromagnetic induction heat generating endless fixing belt. Reference numeral 16 denotes a cylindrical belt guide member which is disposed inside the endless fixing belt and serves as an internal member (support member) supporting the belt, and the endless fixing belt is loosely fitted over the belt guide member 16. Reference numeral 30 is a pressure roller (pressure rotating member) which serves as a back up member for forming a fixing nip portion N between the belt guide member 16 and the pressure roller 30 with the fixing belt 10 interposed.

The cylindrical belt guide member 16 is composed of a pair of left and right gutter type half bodies 16*a* and 16*b* which have nearly semicircular cross sections and openings opposed to each other so as to form a cylindrical body. Inside the right side half body 16*a* of the belt guide member, magnetic cores 17*a*, 17*b* and an excitation coil 18 are disposed and held as magnetic field producing member (magnetic flux producing means). Reference numeral 19 is an insulating member which is disposed on a side of a rear surface of the above described magnetic field producing means. The insulating member 19 serves for insulating the magnetic field producing means 17*a*, 17*b*, and 18 from a pressurizing rigid stay 22 described later.

It is preferable that the belt guide member 16 and the insulating member 19 are made of a material which has an excellent insulating property and high heat resistance. It is preferable to select, for example, phenol resin, fluororesin (PFA resin, PTFE resin, FEP resin), polyimide resin, polyamide resin, polyamideimide resin, PEEK resin, PES resin, PPS resin, LCP resin or the like.

Furthermore, flange members 23*a* and 23*b* having relatively narrow sleeve portions (cylindrical portions) 23*a*1 and 23*b*1 are rotatably fitted over both ends of the cylindrical belt guide member 16 located on a that (deep) side and a this (near) side respectively, and flange restraining members 24*a* and 24*b* are fitted to regulate (restrain) left-right positions of the flange members 23*a* and 23*b*. The regulating members are fixed on a side of the apparatus main unit. The flange members are kept in contact with the regulating members to restrain deviation of the belt in a direction perpendicular to its moving direction. The endless fixing belt 10 is loosely fitted over the belt guide member 16 between the flange members 23*a* and 23*b*, and the flange members 23*a* and 23*b* receive ends of the fixing belt 10 inside the flange portion during rotation of the fixing belt, thereby serving to restrain the fixing belt 10 from deviating in a longitudinal direction of the belt guide member. The flange members are holding members which hold the belt and the sleeve portions of the flange members are located inside the belt and hold the belt. The holding members can rotate together with the belt.

The pressure roller 30 is composed of a core metal 30*a*, a heat resistant elastic layer 30*b* of silicone rubber or fluororubber and a releasing layer 30*b* of fluororesin or the like having a good releasing property which are formed concentrically and integrally in a form of a roller around the core metal, and both ends of the core metal 30*a* are rotatably held with bearings 29*a* and 29*b* between side plates 5*a* and 5*b* on the deep side and the near side of an apparatus chassis 5.

Reference numerals 31*a* and 31*b* are driving rollers (driving rotating members) used as driving members which are disposed coaxially and integrally with the core metal 30*a* outside ends of the heat resistant elastic layer 30*b* of the above described pressure roller 30 located on the deep side and the near side that is at both ends in an axial direction (longitudinal direction) of the pressure roller. These driving rollers 31*a* and 31*b* rotatingly drive the fixing belt 10 outside both the ends of the pressure rotating roller 30 separately from the pressure rotating roller 30 and can be made of a material which is similar to that of the elastic layer 30*b* of the pressure driving roller 30. Taking changes of external forms due to thermal expansion into consideration, the driving rollers 31*a* and 31*b* are configured to have a diameter which is nearly equal to that of the pressure roller 30 so that the driving rotating members 31*a* and 31*b* rotate at a circumferential speed which is nearly equal to that of the pressure roller 30. In addition, "near side" and "deep side" are used in a side view of the apparatus such as FIG. 3, for example, and mean respective end sides in a direction perpendicular to the moving direction of the belt (longitudinal direction of the pressure roller).

A heating member assembly which consists of the above described fixing belt 10, belt guide member 16 (16*a*, 16*b*), magnetic field producing means 18, 17*a*, 17*b*, insulating member 19, flange members 23*a*, 23*b*, flange regulating members 24*a*, 24*b* and so on is disposed over the pressure roller 30, and compressed pressurizing springs 25*a* and 25*b* which are disposed between a ceiling plate member 5*c* of the apparatus chassis and both ends of the pressurizing rigid stay 22 on the deep side and the near side respectively exert a press-down force to the pressurizing rigid stay 22 which is inserted into belt guide member 16. Accordingly, a bottom surface of the belt guide member 16 is in a pressure contact with a top surface of the pressure roller 30 with the fixing belt interposed, thereby forming a fixing nip portion N having a predetermined width.

Furthermore, sleeve portions 23*a*1 and 23*b*1 of the flange members 23*a* and 23*b* on the deep side and near side of the belt guide member 16 are in a condition opposed and in pressure contact to and with driving rotating members 31*a* and 31*b* on the deep side and the near side of the pressure roller 30 with ends on the deep side and the near side of the fixing belt 10 interposed. Pressure contact portions n between the sleeve portions of the flange members 23*a*, 23*b* and the driving rotating members 31*a*, 31*b* on both side of the fixing belt 10 are outside the fixing nip portion N which is formed between the belt guide member 16 and the pressure roller 30 with the fixing belt 10 interposed. In other words, the pressure contact portions n are outside the nip section N as seen in the direction perpendicular to the moving direction of the belt.

Reference symbol G denotes a driving gear which is fixed to an end on the deep side of the core metal 30*a* of the pressure roller 30 and interlocked with driving means M by way of a driving force transmission system.

When a driving force of the driving means M is transmitted to the driving gear G, the pressure roller 30 is rotatingly driven counterclockwise as indicated by an arrow in FIG. 3. When the pressure roller 30 is rotatingly driven, a rotating force is exerted to the fixing belt 10 due to a frictional force between the above described pressure roller 30 and an outside surface of the fixing belt 10, whereby the above described fixing belt 10 is set in a condition where it is rotating along an outer circumference of the belt guide member 16 at a circumferential speed nearly corresponding to a circumferential speed of the pressure roller 30 clockwise as indicated by an arrow while keeping an inner circumferential surface of the fixing belt 10 in close contact with a bottom surface of the belt guide member 16 and sliding the inner circumferential surface on the bottom surface in the fixing nip portion N.

In this case, a heat-resistant low friction force sliding member 40 is disposed on a surface corresponding to the fixing nip portion N of the bottom surface of the belt guide member 16 in order to enhance a sliding property by reducing a mutual sliding frictional force between the bottom surface of the belt guide member 16 and the inside surface of the fixing belt 10 in the fixing nip portion N. Used as a material of the sliding member 40 is PI (polyimide), alumina or alumina coated with glass which has an excellent heat resisting property and a good sliding property on the inside surface of the fixing belt 10. Furthermore, a lubricating agent such as heat-resistant grease may be used between the sliding member 40 and the fixing belt 10 to improve a sliding property.

Figure 4:
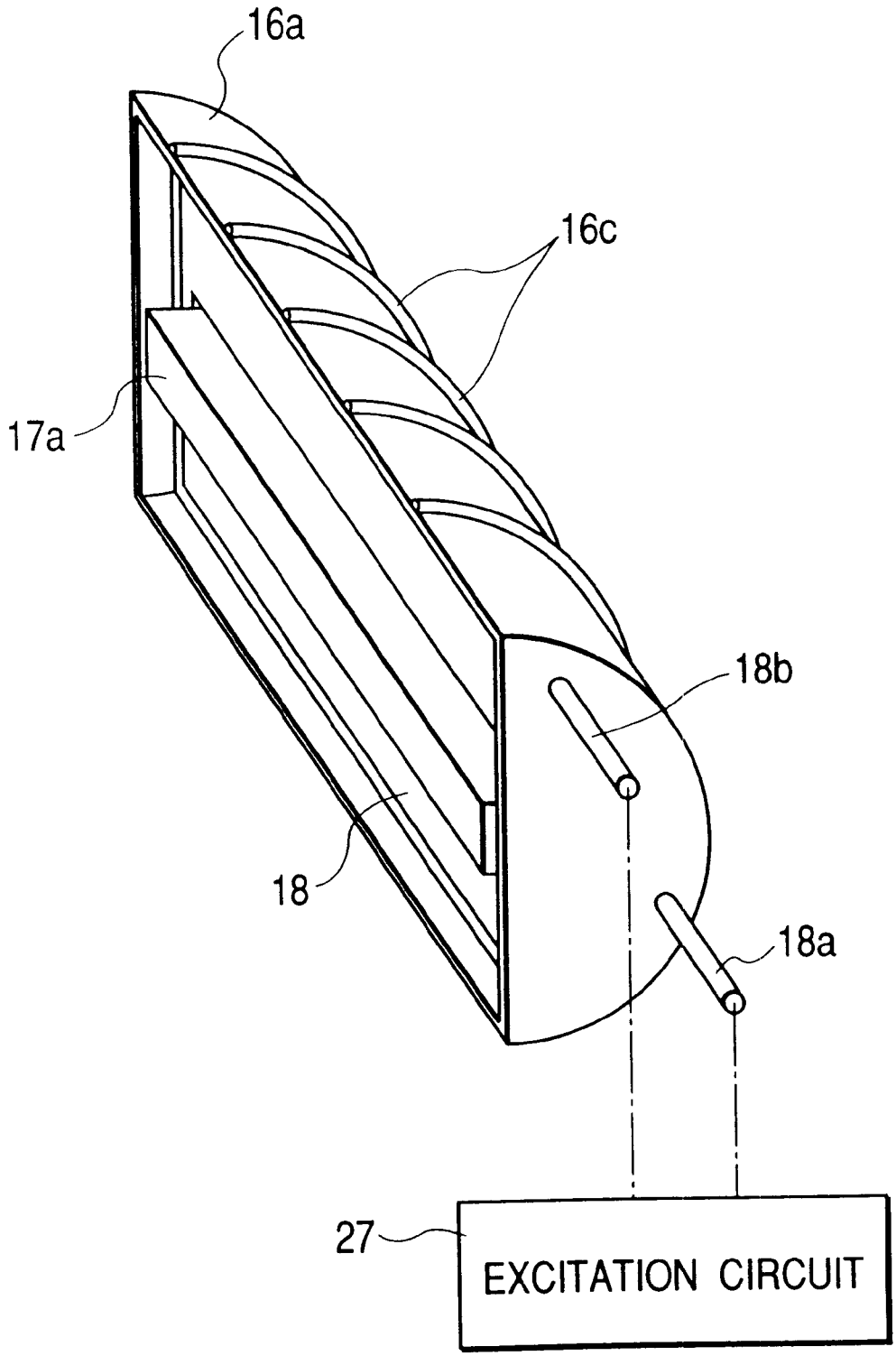
FIG. 4 is a perspective view of a guide.

Furthermore, convex rib portions 16*c* are formed on a circumferential surface of the right side belt guide member half body 16*a* at predetermined intervals in a longitudinal direction as shown in FIG. 4 so as to lessen a rotating load on the fixing belt 10 by reducing contact friction resistance between the belt guide member half body 16*a* and the inside surface of the fixing belt 10. Such convex rib portions 16*c* may be formed also on the left side belt guide half body 16*b*.

Furthermore, the fixing belt 10 has a structure in which the flange members 23*a* and 23*b* are pressurized at locations of the driving rotating members 31*a* and 31*b*, and inner circumferential surfaces of the flange members 23*a* and 23*b* slide on outer circumferential surface at ends of the belt guide member 16. Accordingly, the fixing belt 10 does not slide on the slide member 40 at locations of the driving rotating members. When nickel which is a metal is used as the inside surfaces of the fixing belt 10 in the embodiment, since slide resistance (frictional force) between the flange members 23*a*, 23*b* and the belt guide member 16 is lower than slide resistance (frictional force) between the inside surface of the fixing belt and the sliding member 40, the image heating apparatus is capable of minimizing an increase of slide resistance.

Furthermore, the flange members 23*a* and 23*b* are pressurized by the driving rotating members 31*a* and 31*b* and brought into close contact with the fixing belt 10, whereby rotations of the flange members 23*a* and 23*b* are aided, and the fixing belt 10 and the flange members 23*a*, 23*b* are rotated at circumferential speeds which are nearly equal to one another. Accordingly, edges of the fixing belt 10 are not in slide contact with the inside surfaces of the flange members 23*a* and 23*b*, whereby the fixing apparatus is capable of preventing the edges of the fixing belt from being broken.

Spaces are reserved between the driving rotating members 31*a*, 31*b* and ends of the elastic layer 30*b* of the pressure roller 30 so that a nip section is not formed between the fixing belt 10 and the pressure roller 30. This is because the fixing belt 10 may be broken at a portion on which stresses are concentrated when the pressure roller 30 or the driving rotating members 31*a* or 31*b* rides over the end of the slide member 40 or the end of the flange members 23*a* or 23*b* and stresses are concentrated on a portion over which the ends ride.

At a location where the fixing belt 10 is in contact with the driving roller, transmission of the driving force can be improved by setting dynamical frictional resistance on an uppermost layer of the fixing belt 10 in a relation of dynamical frictional resistance at a location of the driving rotating member>dynamical frictional resistance at a location of the pressure roller. In other words, a belt conveying force of the driving rotating member is greater than a belt conveying force of the pressure roller.

Surface roughness, for example, of the fixing belt 10 is set in a relation of surface roughness at the location of the driving rotating member>surface roughness at the location of the pressure roller. Alternately, the transmission of the driving force can be improved by removing the releasing layer of the belt from the location of the driving rotating member and using an elastic layer of rubber or the like instead.

In a condition where the pressure roller 30 and the driving rotating members 31*a*, 31*b* are rotatingly driven, the fixing belt 10 is rotated accordingly, the fixing belt 10 which is used as the heating member generates electromagnetic induction heat owing to a function of a magnetic field produced by power supply from an excitation circuit 27 (FIG. 4) to the excitation coil 18 and the fixing nip portion N is heated and controlled at a predetermined temperature, the recording material P which is carried from the image forming means and on which an unfixed toner image t is formed is introduced between the fixing belt 10 and the pressure roller 30 in the fixing nip portion N with an image surface set upside, that is, opposed to a surface of the fixing belt, and sandwiched and carried together with the fixing belt 10 through the fixing nip portion N with the image surface kept in close contact with the outside surface of the fixing belt 10 in the fixing nip portion N.

At a process where the recording material P is sandwiched and carried together with the fixing belt 10 through the fixing nip portion N, the fixing belt 10 generates the electromagnetic heat, thereby heating and fixing the unfixed toner image t to the recording material P. After passing through the fixing nip portion N, the recording material P is separated from the outside surface of the fixing belt 10, thereafter being discharged and carried. After passing through the fixing nip portion N, the toner image heated and fixed on the recording material P is cooled and becomes a permanently fixed image.

Though the fixing apparatus 100 preferred as the embodiment uses a toner t which contains a softening substance and is not equipped with an oil coating mechanism for offset prevention, the fixing apparatus may be equipped with an oil coating mechanism when it uses a toner which does not contain a softening substance. Furthermore, oil coating and cooling separation may be carried out even when a toner containing a softening substance is used.

The embodiment is capable of strengthening a rotational driving force for the fixing belt 10 and preventing the fixing belt 10 from slipping since fixing belt driving means 31*a*, 31*b*, 23*a* and 23*b* for rotating drive of the fixing belt 10 is disposed separately from the pressure roller 30 outside a nip region of the nip section N which is formed by the belt guide member 16 (sliding member 40) and the pressure roller 30 with the fixing belt 10 sandwiched as described above.

Furthermore, the embodiment is capable of restraining slide resistance from being increased and rotating the fixing belt 10 without slipping since the fixing belt driving means separate from the pressure roller 30 is the flange members 23*a* and 23*b* which are disposed as the fixing belt holding members inside the fixing belt 10 and outside the nip region of the nip section N and the driving rotating members 31*a* and 31*b* which are disposed in opposition and pressure contact to and with the flange members 23*a* and 23*b* with the fixing belt 10 sandwiched, and the flange members 23*a* and 23*b* are disposed on the side of the inside ends of the fixing belt 10 and rotate at a speed nearly equal to that of the fixing belt 10 while following a rotation of the fixing belt 10. Since the belt is driven not only in the nip section N where the belt is in slide contact with the guide but also at the pressure contact portions n where the belt is pressed by the driving rotating members in particular, the embodiment is capable of lessening a load on the belt which is imposed by driving in the nip section N and restraining the belt from being deteriorated.

Furthermore, the embodiment makes it possible to carry the recording material P stably without slipping the fixing belt 10 even when the slide resistance between the fixing belt 10 and the belt guide member 16 (sliding member 40) is higher than the frictional resistance between the pressure roller 30 and the fixing belt 10 or when the frictional resistance between the pressure roller and the recording material P is lower than the slide resistance between the fixing belt 10 and the belt guide member 16 (40).

However, it is preferable for determining a distance between the transfer section and the fixing nip portion N to take into consideration a fact that a carriage speed of the recording material is changed due to thermal expansion caused by temperature changes of the pressure roller 30 and the driving rotating members 31*a*, 31*b*. Accordingly, it is preferable that a carriage path has a distance and a concavity sufficient for the recording material P to form a loop so that the recording material P is not pulled between the transfer section and the fixing nip portion N and can absorb a change of the carriage speed.

The magnetic field producing means consists of the excitation coil 18 and the magnetic cores 17*a*, 17*b*.

The magnetic cores 17*a* and 17*b* which are members having a high magnetic permeability are made preferably of a material used for a core of a transformer such as ferrite or permalloy, or more preferably of ferrite which is lost little even at 100 Khz or higher.

The excitation coil 18 uses, as a conductor (electric wire) composing a coil (wire windings), a bundle (wire bundle) which consists of several thin copper wires each having an insulating sheath and is wound a plurality of turns to form the excitation coil. In the embodiment, the wire bundle is wound 10 turns to compose the excitation coil 18.

Taking conduction of the heat generated by the fixing belt 10 into consideration, it is preferable to use a sheath which has a heat resistant property. For example, it is preferable to use a sheath made of amideimide or polyimide.

An external pressure may be applied to the excitation coil 18 to enhance a density.

The excitation coil 18 has a form which is curved along a curved surface of the heat generating layer of the fixing belt 10. In the embodiment, a distance of approximately 2 mm is reserved between the heat generating layer of the fixing belt 10 and the excitation coil 18.

Though the magnetic flux is absorbed at a higher efficiency as a distance is shorter from the magnetic cores 17*a*, 17*b* and the excitation coil 18 to the heat generating layer of the fixing belt 10, it is preferable to set this distance within 5 mm since the efficiency is remarkably lowered when the distance exceeds 5 mm. Furthermore, the distance from the heat generating layer of the fixing belt to the excitation coil 18 may not be constant so far as the distance is within 5 mm.

Speaking of outgoing lines 18*a* and 18*b* (FIG. 4) from the excitation coil holding member of the excitation coil 18, portions outside the excitation coil holding member have insulating sheaths covering wire bundles.

The excitation coil 27 (FIG. 4) is connected across power supply parts 18*a* and 18*b* of the excitation coil 18. The excitation circuit 27 is configured to be capable of generating high-frequency waves from 20 Khz to 500 Khz with a switching power source.

The excitation coil 18 generates an alternating magnetic flux with an alternating current (high-frequency current) supplied from the excitation circuit 27.

Figure 5:
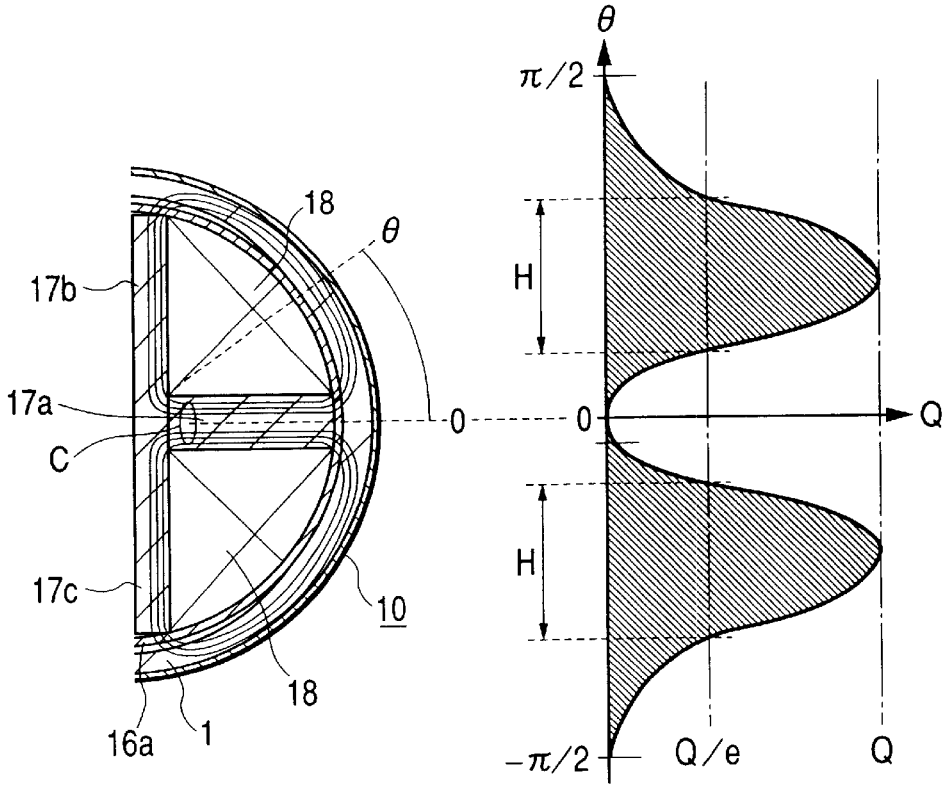
FIG. 5 is a diagram showing relationship between magnetic field producing means and a heat generating value.

FIG. 5 schematically shows a manner to generate an alternating magnetic flux. A magnetic flux C denotes a portion of a generated alternating magnetic flux. The magnetic flux C which is led to the magnetic cores 17*a* and 17*b* produces an eddy current in the electromagnetic induction heat generating layer 1 of the fixing belt 10 between the magnetic cores 17*a* and 17*b*. This eddy current generates Joule heat (eddy current loss) due to a resistivity of the electromagnetic induction heat generating layer. A heat generating amount Q is determined herein by a density of a magnetic flux passing through the electromagnetic induction heat generating layer and distributed as represented by a graph shown in FIG. 5.

In the graph shown in FIG. 5, a vertical axis denotes a location in a circumferential direction on the fixing belt 10 expressed as an angle θ around a center of the magnetic core 17*a* and a horizontal axis denotes the heat generating amount Q in the electromagnetic induction heat generating layer of the fixing belt 10. When a maximum heat generating amount is represented by Q, a heat generating region H is defined as a region which has a heat generating amount not smaller than Q/e. This is a region in which a heat generating amount required for fixing is obtained.

A temperature in the fixing nip portion N is controlled so as to be kept at a predetermined level with a temperature control system including temperature detecting means 26 (FIG. 1) which controls a current supplied to the excitation coil 18. The temperature detecting means 26 is a temperature sensor such as a thermistor which detects a temperature of the fixing belt 10 and the embodiment is configured to control the temperature of the fixing nip portion N on the basis of temperature data of the fixing belt 10 measured with the temperature sensor 26.

Figure 6:
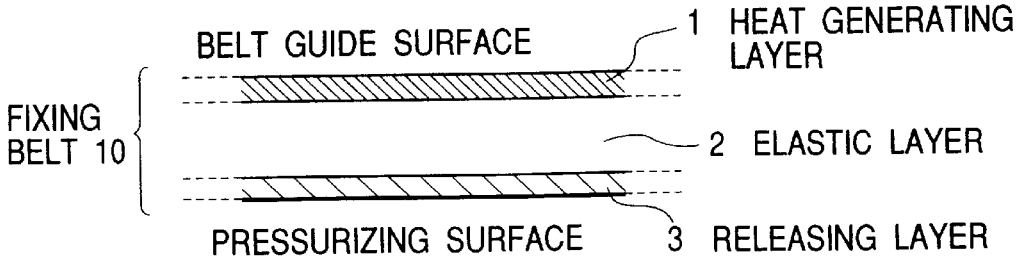
FIG. 6 is a diagram showing a layer configuration of a belt.

FIG. 6 is a schematic diagram showing a layer configuration of the fixing belt 10 in the embodiment.

In the embodiment, the fixing belt 10 has a composite configuration consisting of a heat generating layer 1 which is composed of a metal film or the like as a base layer of an electromagnetic induction heat generating fixing belt, an elastic layer 2 which is laminated with an outside surface of the heat generating layer 1 and a releasing layer 3 which is laminated further with an outside surface of the elastic layer 2.

Primer layers (not shown) may be disposed between the heat generating layer 1 and the elastic layer 2 and between the elastic layer 2 and the releasing layer 3 for bonding these layers to one another.

On the fixing belt 10 which is nearly cylindrical, the heat generating layer 1 forms an inside surface and the releasing layer 3 forms an outside surface. An eddy current is produced in the heat generating layer 1 and the heat generating layer 1 generates heat when an alternating magnetic flux is produced in the heat generating layer 1. By way of the elastic layer 2 and the releasing layer 3, the heat generated in the heat generating layer 1 heats the recording material P fed into the fixing nip portion N, thereby heating and fixing the toner image t.

It is preferable to make the heat generating layer 1 of a ferromagnetic metal such as nickel, iron, ferromagnetic SUS or a nickel-cobalt alloy.

Though the heat generating layer 1 may be made of a non-magnetic metal, it is more preferable to make the heat generating layer 1 of nickel, iron, magnetic stainless steel or a cobalt-nickel alloy which absorbs a magnetic flux favorably.

It is preferable that the heat generating layer 1 has thickness which is larger than a depth of a surface skin expressed by an equation shown below and not larger than 200 $\mu$m. Using a frequency f [Hz] and a magnetic permeability $\mu$ and a resistivity $\rho$ of the excitation circuit, a depth of a surface skin $\sigma$ [m] is expressed as:

$$\sigma=503\times(\rho/f\mu)^{1/2}$$

Figure 8:
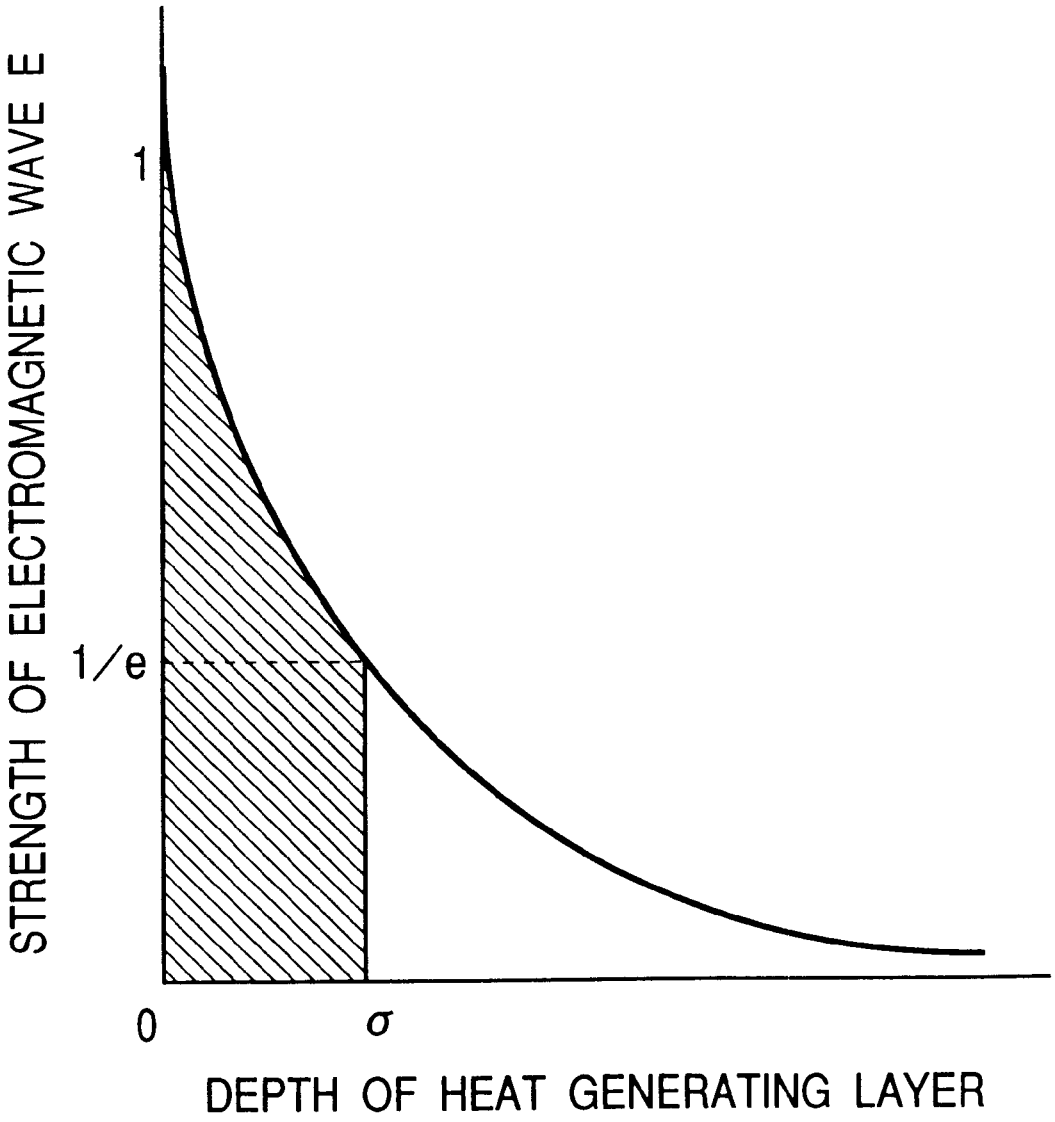
FIG. 8 is a diagram showing relationship between depth of a heat generating layer and strength of an electromagnetic wave.

The depth of the surface skin denotes an absorption depth of an electromagnetic wave used for the electromagnetic induction beyond which strength of the electromagnetic wave is not higher than 1/e. Speaking reversely, almost all energy is absorbed before the electromagnetic wave reaches this depth (FIG. 8).

It is preferable that the heat generating layer 1 has thickness of 1 to 100 $\mu$m. When the heat generating layer 1 has thickness smaller than 1 $\mu$m, the layer cannot absorb almost all energy, thereby lowering an efficiency. When the heat generating layer 1 has a depth exceeding 100 $\mu$m, in contrast, the layer has too high a rigidity and a low deflecting property, thereby being practically unusable. Accordingly, it is preferable that the heat generating layer 1 has thickness of 1 to 100 $\mu$m.

The elastic layer 2 is made of silicone rubber, fluororubber, fluorosilicone rubber or the like which is a material having heat resistance and a high heat conductivity.

It is preferable that the elastic layer 2 has thickness of 10 to 500 $\mu$m. This elastic layer 2 is necessary to ensure a quality of a fixed image such as a color image.

When a color image, a photographic image in particular, is printed, a solid image is formed over a large area on the recording material P. If a heating surface (the releasing layer 3) cannot follow convexities and concavities on the recording material P or a toner layer t in this case, ununiform heating occurs, thereby making gloss ununiform between an area to which heat is transferred in a large amount and an area to which heat is transferred in a small amount. The area to which heat is transferred in the large amount has high glossiness and the area to which heat is transferred in the small amount has low glossiness.

When the elastic layer 2 has thickness smaller than 10 $\mu$m, the heating surface cannot follow the convexities and concavities on the recording material or the toner layer, thereby producing image gloss ununiformity. When the elastic layer 2 has thickness not smaller than 1000 $\mu$m, in contrast, the elastic layer has high thermal resistance, thereby making quick start difficult. It is more preferable that the elastic layer 2 has thickness of 50 to 500 $\mu$m.

When the elastic layer 2 has too high hardness, the heating surface cannot follow the convexities and the concavities on the recording material P or toner layer t, thereby producing the image gloss ununiformity. Hardness of the elastic layer 2 is preferably not higher than 60° (JIS-A: JIS-K A type tester) or more preferably not higher than 45°.

A heat conductivity $\lambda$ of the elastic layer 2 is preferably $6\times10^{-4}$ to $2\times10^{-3}$ [cal/cm.sec.deg] ($2.51\times10^{-1}$ to $8.37\times10^{-1}$ [W/m.k]). When the heat conductivity $\lambda$ is lower than $6\times10^{-4}$ [cal/cm.sec.deg], thermal resistance is high and temperature rise is slow on the surface layer (the releasing layer 3) of the fixing belt 10. When the heat conductivity $\lambda$ is higher than $2\times10^{-3}$ [cal/cm.sec.deg], hardness is too high or compression set is aggravated. Accordingly, it is preferable that the heat conductivity $\lambda$ is $6\times10^{-4}$ to $2\times10^{-3}$ [cal/cm.sec.deg]. It is more preferable that the heat conductivity $\lambda$ is $8\times10^{-4}$ to $1.5\times10^{-3}$ [cal/cm.sec.deg] ($3.35\times10^{-1}$ to $6.28\times10^{-1}$ [W/m.k]).

Selectable as a material for the releasing layer 3 is a substance which has a good releasing property and high heat resistance such as fluororesin (PFA, PTFE, FEP), silicone resin, fluorosilicone rubber, fluororubber or silicone rubber.

It is preferable that the releasing layer 3 has thickness of 1 to 100 $\mu$m. When the releasing layer 3 has thickness smaller than 1 $\mu$m, ununiformity of a coated layer produces a portion having a low releasing characteristic or poses a problem of insufficient durability. When the releasing layer is thicker than 100 $\mu$m, in contrast, the releasing layer poses a problem of a lowered heat conductivity or the releasing layer which is made of a resin has too high hardness and makes the elastic layer 2 ineffective.

Figure 7:
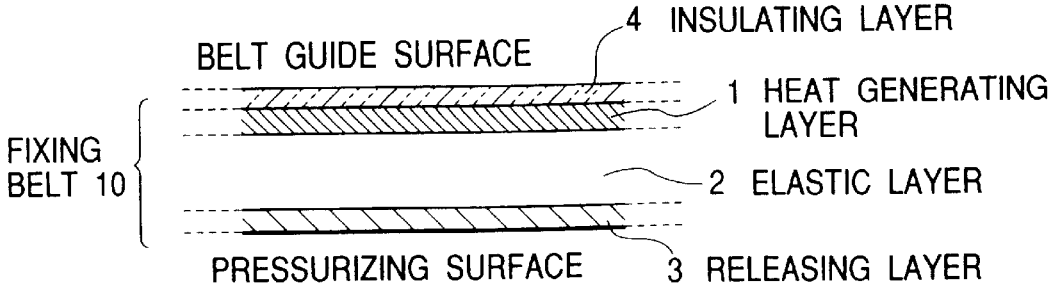
FIG. 7 is a diagram showing another layer configuration of the belt.

Furthermore, the fixing belt 10 may have a configuration in which a heat insulating layer 4 is disposed on a side of a free surface of the heat generating layer 1 (on a side of the heat generating layer 1 opposite to the elastic layer 2) as shown in FIG. 7.

It is preferable that the heat insulating layer 4 is made of a heat resistant resin such as fluororesin (PFA resin, PTFE resin, FEP resin), polyimide resin, polyamide resin, polyamideimide resin, PEEK resin, PES resin or PPS resin.

Furthermore, it is preferable that the heat insulating layer 4 has thickness of 10 to 1000 $\mu$m. When the heat insulating layer 4 has thickness smaller than 10 $\mu$m, the layer cannot exhibit a heat insulating effect and has insufficient durability. When the heat insulating layer 4 has thickness exceeding 1000 $\mu$m, on the other hand, the distance from the magnetic core 17 and the excitation coil 18 to the heat generating layer 1 is prolonged, whereby the magnetic flux cannot be absorbed sufficiently by the heat generating layer 1.

The heat insulating layer 4 is capable of intercepting the heat generated by the heat generating layer 1 so that the heat is not directed inside the fixing belt 10, thereby enabling to supply heat to the recording material P with an efficiency higher than that available when the heat insulating layer 4 is not disposed. Thereby, it is possible to decrease power consumption.

In the fixing apparatus preferred as the embodiment, a thermoswitch 50 is disposed as a temperature detecting element at a location opposed to a heat generating region H (FIG. 5) of the fixing belt 10 as shown in FIG. 3 in order to intercept power supply to the excitation coil 18 at a overrun time.

Figure 9:
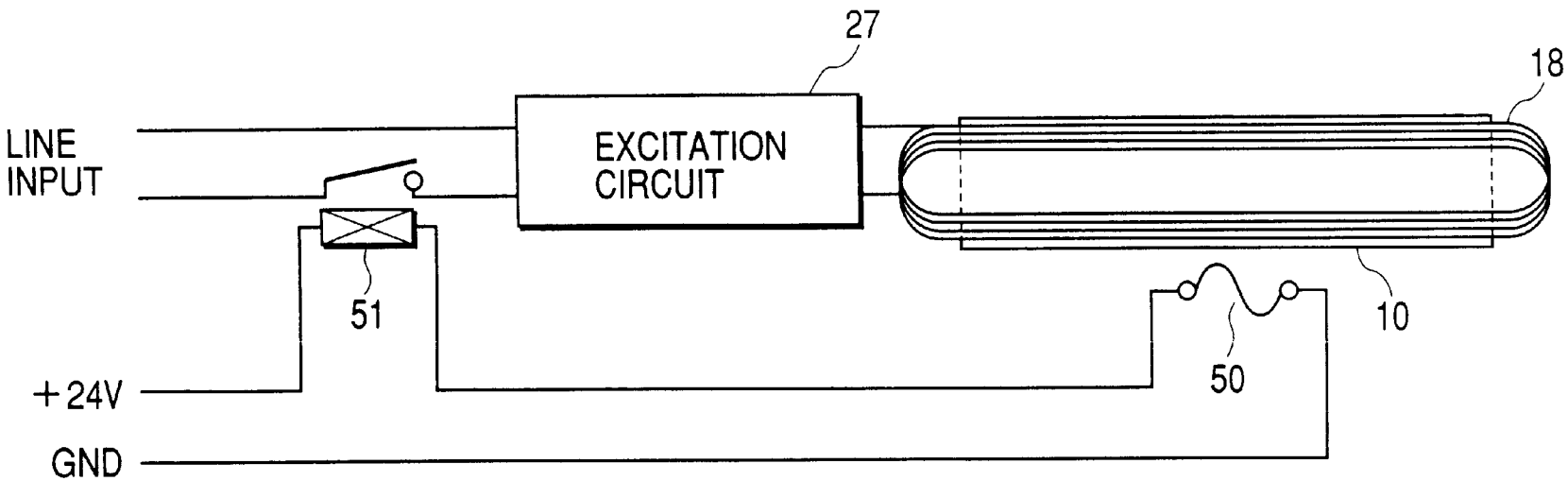
FIG. 9 is a diagram showing a safety circuit.

FIG. 9 is a circuit diagram of the safety circuit used in this embodiment. The thermoswitch 50 adopted as the temperature detecting element is connected to a +24V DC power source in series with a relay switch 51, and when the thermoswitch 50 is turned off, power supply to the relay switch 51 is intercepted and the relay switch 51 operates to intercept power supply to the excitation circuit 27, thereby intercepting power supply to the excitation coil 18. The thermoswitch 50 is set so as to be turned off at a temperature of 220° C.

Furthermore, the thermoswitch 50 is disposed contactlessly over an outside surface of the fixing belt 10 so as to oppose to the heat generating region H of the fixing belt 10. A distance of approximately 2 mm is reserved between the thermoswitch 50 and the fixing belt 10. Thereby, the fixing belt 10 is not injured by the touch of the thermoswitch 50, and consequently the deterioration of a fixed image caused by durability can be prevented.

Figure 16:
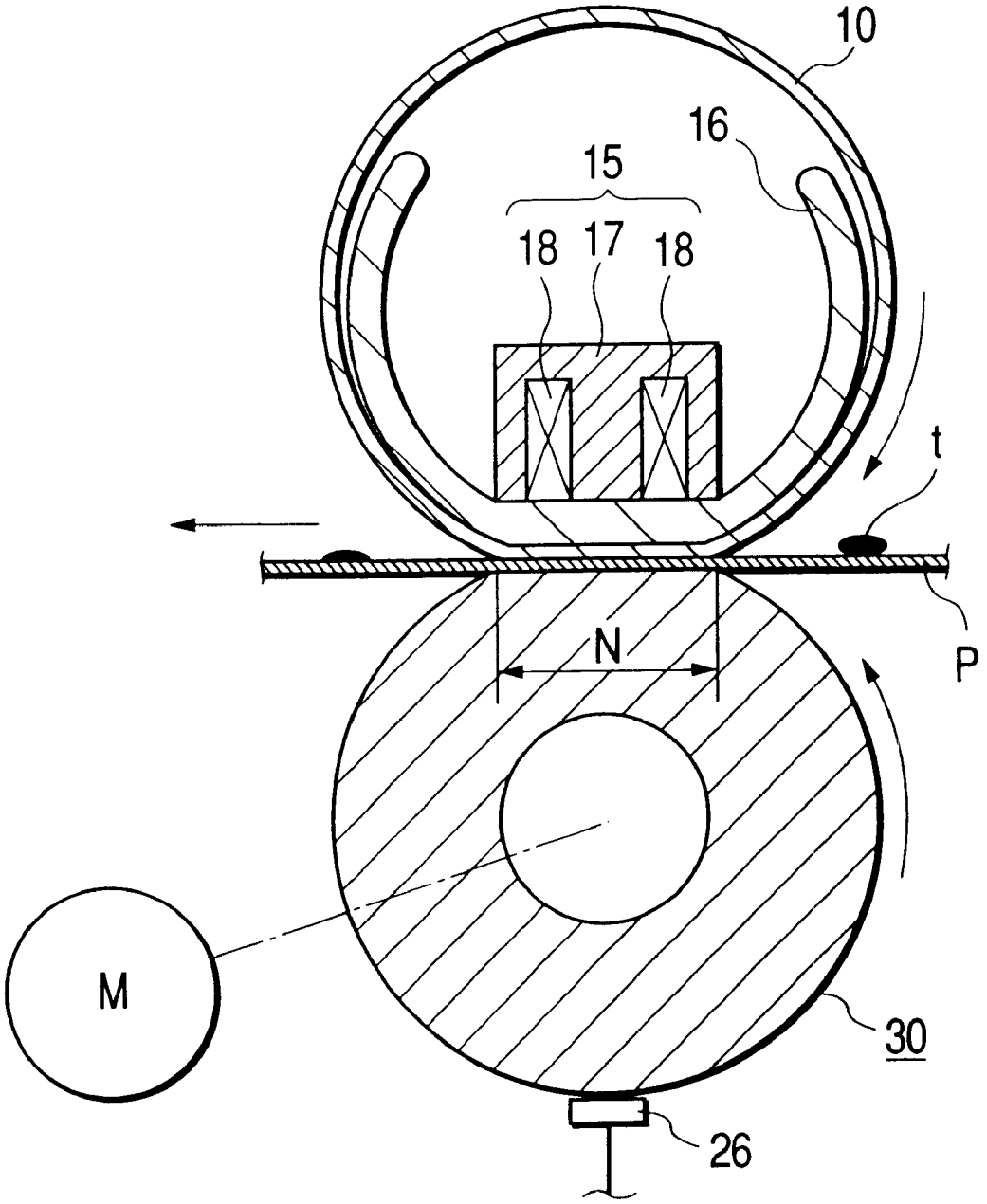
FIG. 16 is a diagram showing a conventional image heating apparatus.

Unlike the above described fixing apparatus shown in FIG. 16 having a configuration which allows heat to be generated in the fixing nip portion N when the fixing apparatus runs over due to a trouble, the embodiment stops the apparatus in a condition where paper is caught in the fixing nip portion N but does not allow heat to be generated in the fixing nip portion N in which the paper is caught and does not heat the paper directly even when power supply to the excitation coil 18 continues and the fixing belt 10 generates heat continuously. Furthermore, the thermoswitch 50 disposed in the heat generating region H which has a large heat generating amount detects 220° C. and power supply to the excitation coil 18 is intercepted by the relay switch 51 when the thermoswitch is turned off.

The embodiment is capable of stopping heat generation of the fixing belt without igniting paper since paper has an ignition temperature in the vicinity of 400° C.

In addition to the thermoswitch, a thermal fuse is usable as a temperature detecting element.

Another embodiment of the present invention will be described with reference to FIGS. 10 and 11.

A fixing apparatus preferred as this embodiment has the configuration of the fixing apparatus 100 preferred as the above described embodiment, in which the pressure roller 30 is separated from the driving rotating members 31*a* and 31*b*, and the pressure roller 30 is rotated as a follower of the fixing belt 10.

Figure 10:
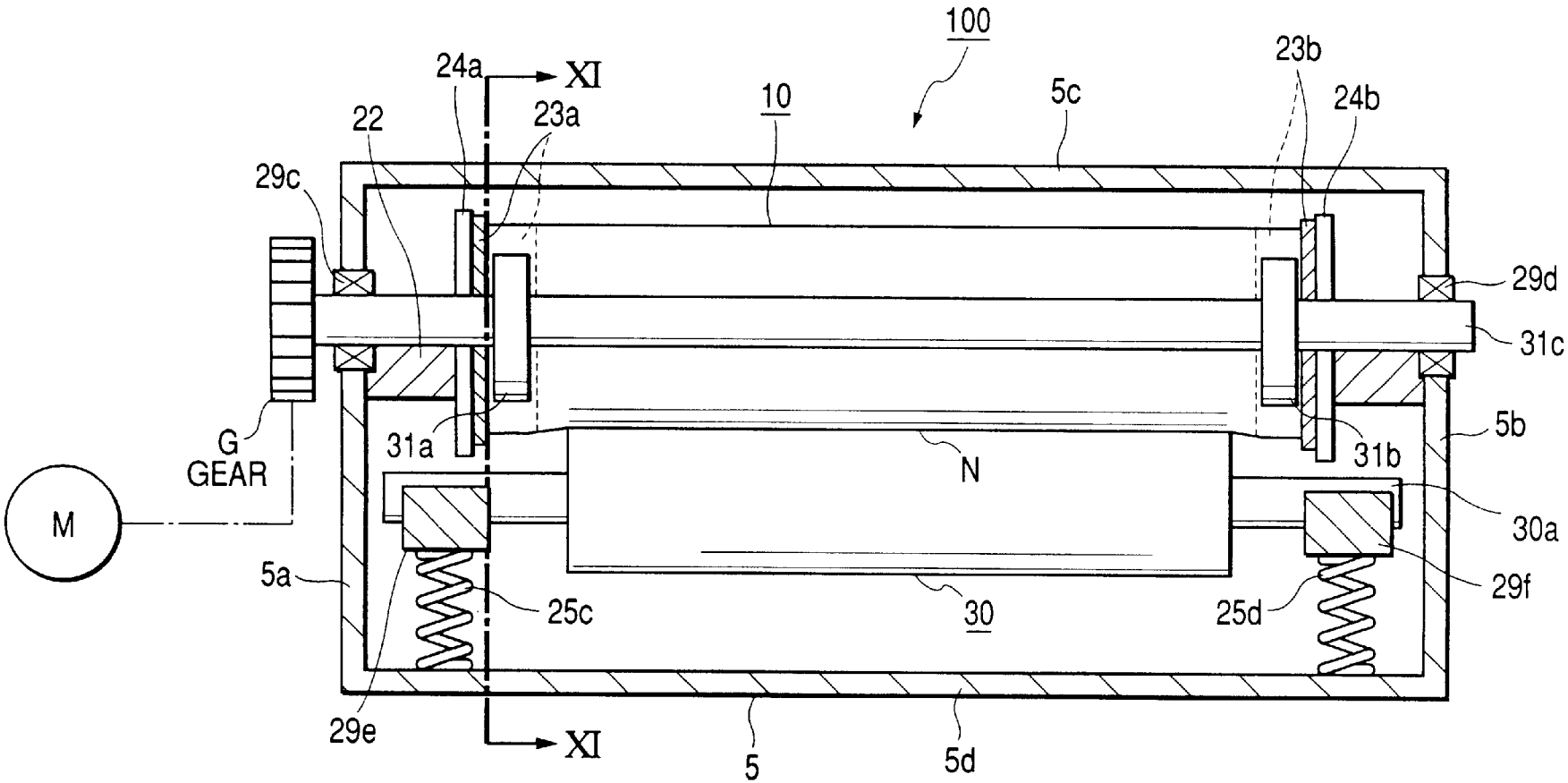
FIG. 10 is a front view of an image heating apparatus as another embodiment.
Figure 11:
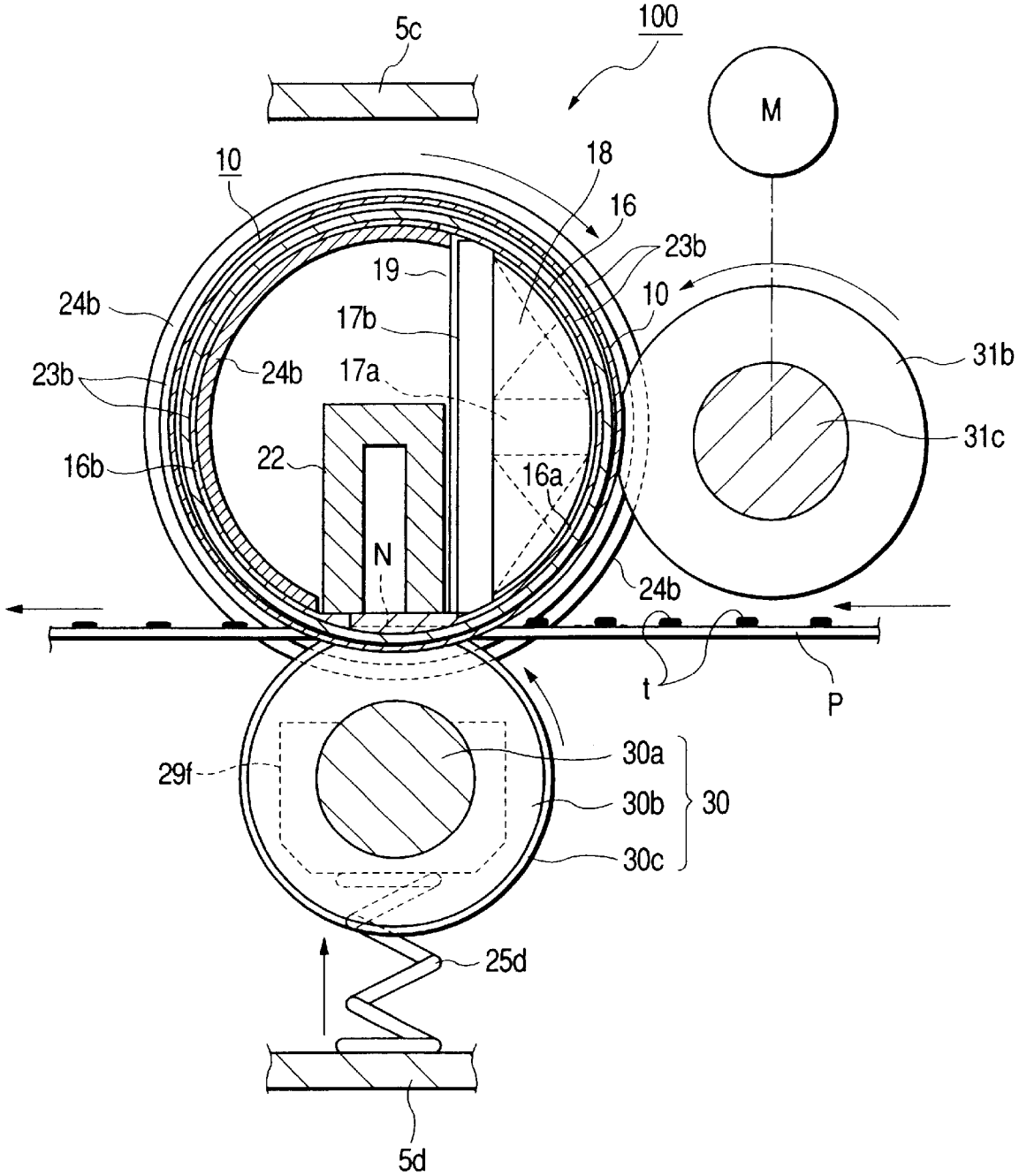
FIG. 11 is a side sectional view of the image heating apparatus.

FIG. 10 is a schematic front view of the fixing apparatus preferred as the embodiment and FIG. 11 is a schematic cross sectional view taken along a XI—XI line in FIG. 10. Component members and parts which are common to the fixing apparatus preferred as the above described embodiment will be represented by the same reference numerals and will not be described once again.

Both ends at the deep side (inner side) and near side (this side) of the pressurizing rigid stay 22 on a side of the heating member assembly are fixed and held between the side plates 5*a* and 5*b* on the deep side and the near side of the apparatus chassis 5.

Ends on the deep side and the near side of the core metal 30*a* of the pressure roller 30 are rotatably held with movable bearings 29*e* and 29*f*. The movable bearings 29*e* and 29*f* are urged upward with pressurizing springs 25*c* and 25*d* which are compressedly disposed between the pressure roller 30 and bottom plate 5*d* of the apparatus chassis 5. Accordingly, a top surface of the pressure roller 30 is in pressure contact with a bottom surface of the belt guide member 16 on a side of the heating member assembly with the fixing belt 10 interposed, thereby forming a fixing nip portion N having predetermined width.

The driving rotating members 31*a* and 31*b* are separated from the pressure roller 30, and both ends of a core metal 31*c* which fixes and supports the driving rotating members 31*a* and 31*b* are rotatably held with bearings 29*c* and 29*d* between the side plates 5*a* and 5*b* on the deep side and the near side of the apparatus chassis 5.

At a location of approximately 90° upstream side in the rotating direction of the fixing belt from the fixing nip portion N, the driving rotating members 31*a* and 31*b* are in a condition where the members are opposed to each other and in pressure contact with the ends on the deep side and the near side of the fixing belt 10 interposed between the sleeve portions of the flange members 23*a* and 23*b* used as belt holding members on the deep side and the near side of the belt guide member 16. The driving rotating members 31*a* and 31*b* are pressurized to the fixing belt 10 by pressuring means between a pressure holding member 22 and the driving rotating members core metal 31*c* or the bearings 29*c* and 29*d*.

Contact portions between the sleeve portions of the flange members 23*a* and 23*b* and the driving rotating members 31*a* and 31*b* with the fixing belt 10 interposed are outside the fixing nip portion N formed by the belt guide member 16 and the pressure roller 30 with the fixing belt 10 interposed.

When the driving rotating members 31*a* and 31*b* are rotatingly driven counterclockwise in FIG. 11, rotating forces are exerted to ends on the deep side and the near side of the fixing belt 10 which are in pressure contact with the driving rotating members 31*a* and 31*b*, whereby the fixing belt 10 is set in a condition where the belt is rotating clockwise as indicated by an arrow along an outer circumference of the belt guide member 16 at a circumferential speed nearly corresponding to a circumferential speed of the driving rotating members 31*a* and 31*b*. Since the flange members 23*a* and 23*b* which are put between the end portions of the fixing belt 10 opposed to the driving rotating members 31*a* and 31*b* are rotatable at the ends of the belt guide member 16, the flange members 23*a* and 23*b* are also rotated together with the fixing belt 10 at a nearly equal speed.

The driving rotating members 31*a* and 31*b* are coated with silicone rubber 0.1 mm thick. This is for the purpose of strengthening a driving force to the fixing belt 10 by utilizing tack of silicone rubber. By thinning the elastic layer, it is possible to make negligible diametrical expansion due to the temperature changes of the driving rotating members 31*a* and 31*b*, thereby reducing a change of a rotating speed of the fixing belt 10. In this embodiment, the elastic layer of the driving rotating member is thinner than the elastic layer of the pressure roller.

On the other hand, the pressure roller 30 which forms the fixing nip portion N by putting the fixing belt 10 between the bottom surface of the belt guide member 16 and the pressure roller is rotated as a follower as the fixing belt 10 rotates. When the pressure roller 30 is rotated as the follower of the fixing belt 10, a diametrical change due to thermal expansion of the elastic layer 30*b* of the pressure roller 30 does not influence on a carriage speed of the recording material P.

In a condition where the driving rotating members 31*a* and 31*b* are rotatingly driven, the pressure roller 30 is rotated accordingly, the fixing belt 10 generates electromagnetic induction heat owing to a magnetic field produced by power supplied to the excitation coil 18 and the fixing nip portion N is heated and controlled at a predetermined level, the recording material which is carried from the image forming means and on which an unfixed toner image t is formed is introduced between the fixing belt 10 and the pressure roller 30 in the fixing nip portion N with an image surface set upside, that is, opposed to a surface of the fixing belt, sandwiched and carried together with the fixing belt 10 through the fixing nip portion N with the image surface kept in close contact with the outside surface of the fixing belt 10.

At a process where the recording material P is sandwiched and carried together with the fixing belt 10 through the fixing nip portion N, the unfixed toner image t on the recording material P is heated and fixed with electromagnetic induction heat generated by the fixing belt 10. After passing through the fixing nip portion N, the recording material P is separated from the rotating fixing belt 10, thereafter being discharged and carried. After passing through the fixing nip portion N, the toner image t heated and fixed on the recording material P cooled and becomes a permanently fixed image.

Since the fixing apparatus preferred as the embodiment is capable of maintaining the carriage speed of the fixing belt 10 nearly constant regardless of temperature changes as described above, the fixing apparatus permits reserving a distance between a transfer section of the image forming means and the fixing nip portion N which is shorter than that in the above described embodiment.

Figure 12:
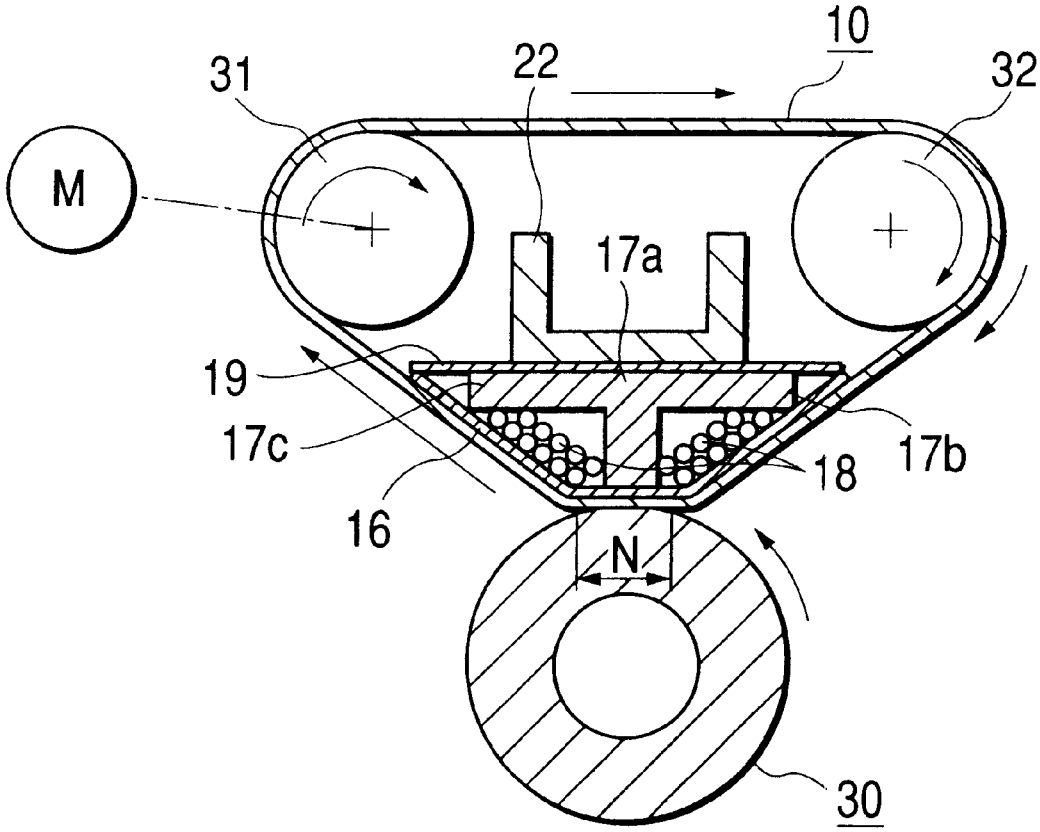
FIG. 12 is a side view of an image heating apparatus as a reference example of the present invention.

FIG. 12 is a schematic configurational diagram of an electromagnetic induction heat generating type fixing apparatus selected as a reference example in which a driving roller 31 is disposed on an inside surface of a fixing belt 10. This fixing apparatus has a configuration in which the fixing belt 10 composed of an electromagnetic induction heat generating endless belt is stretched over a belt guide member 16, the driving rotating member 31 and a tension roller 32, and a bottom surface of the belt guide member 16 is brought into pressure contact with a pressure roller 30 used as a pressurizing member with the fixing belt 10 interposed to form a fixing nip portion N, and the fixing belt 10 is rotated with the driving roller 31. In this case, the pressurizing roller 30 is a driven rotating roller. Disposed inside the belt guide member 16 are magnetic cores 17*a*, 17*b* and 17*c* and an excitation coil 18 as magnetic field producing means.

Unlike the fixing apparatus shown in FIG. 12 having the configuration in which the driving roller 31 is disposed on an inside surface of the fixing belt 10, the fixing apparatus 100 preferred as the embodiment shown in FIGS. 10 and 11 forms a region N for heating a recording material P which has a heat capacity equal to that of the pressurizing roller driving type and provides a rise time to a fixing temperature which is equal to that of the pressurizing roller driving type.

Furthermore, the fixing apparatus 100 preferred as the embodiment which separates the driving rotating members 31*a* and 31*b* from the pressure roller 30 and drives the fixing belt 10 from outside is capable of reducing a change of a carriage speed due to temperature changes, thereby making it possible to carrying a recording material stably, shorten a distance between a transfer nip section of an image forming portion and the fixing nip portion N and configure an image forming apparatus main unit more compact.

Now, still another embodiment of the present invention will be described with reference to FIGS. 13 and 14.

This embodiment is an example of film heating type fixing apparatus which uses a ceramic heater as a heating body.

Figure 13:
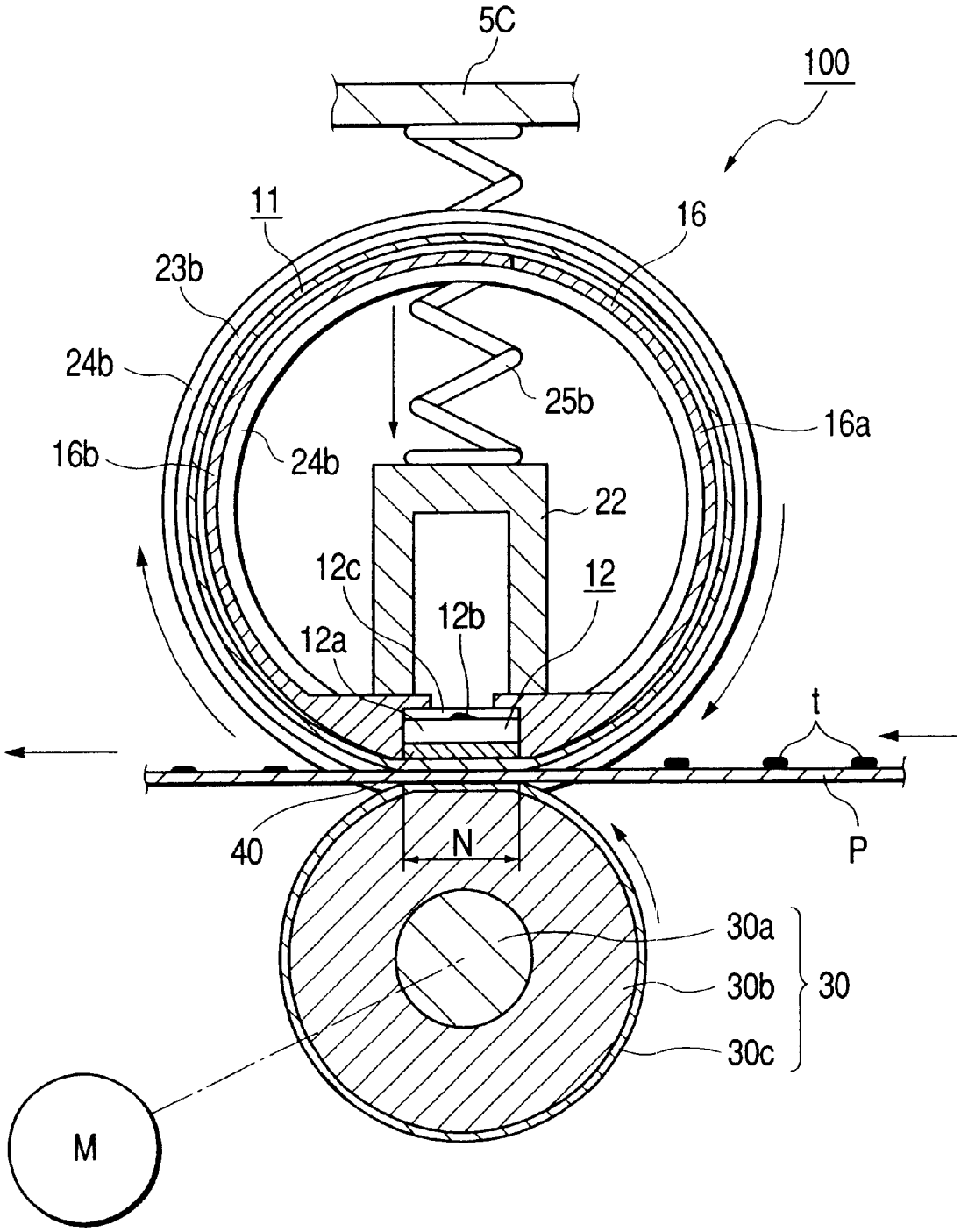
FIG. 13 is a side view of an image heating apparatus preferred as still another embodiment.

FIG. 13 shows the fixing apparatus preferred as the above described embodiment (FIGS. 1 through 3) in which the electromagnetic induction heat generating fixing belt 10 is replaced with a cylindrical or endless heat-resistant fixing belt (film) 11, the magnetic cores 17*a* and 17*b* and the excitation coil 18 which are used as the magnetic field producing means are omitted and a ceramic heater 12 is disposed instead as a heating body on a bottom surface portion of a belt guide member 16 corresponding to the fixing nip portion N. In other respects, a configuration of the embodiment is similar to that of the above described embodiment and will not be described once again.

Figure 14:
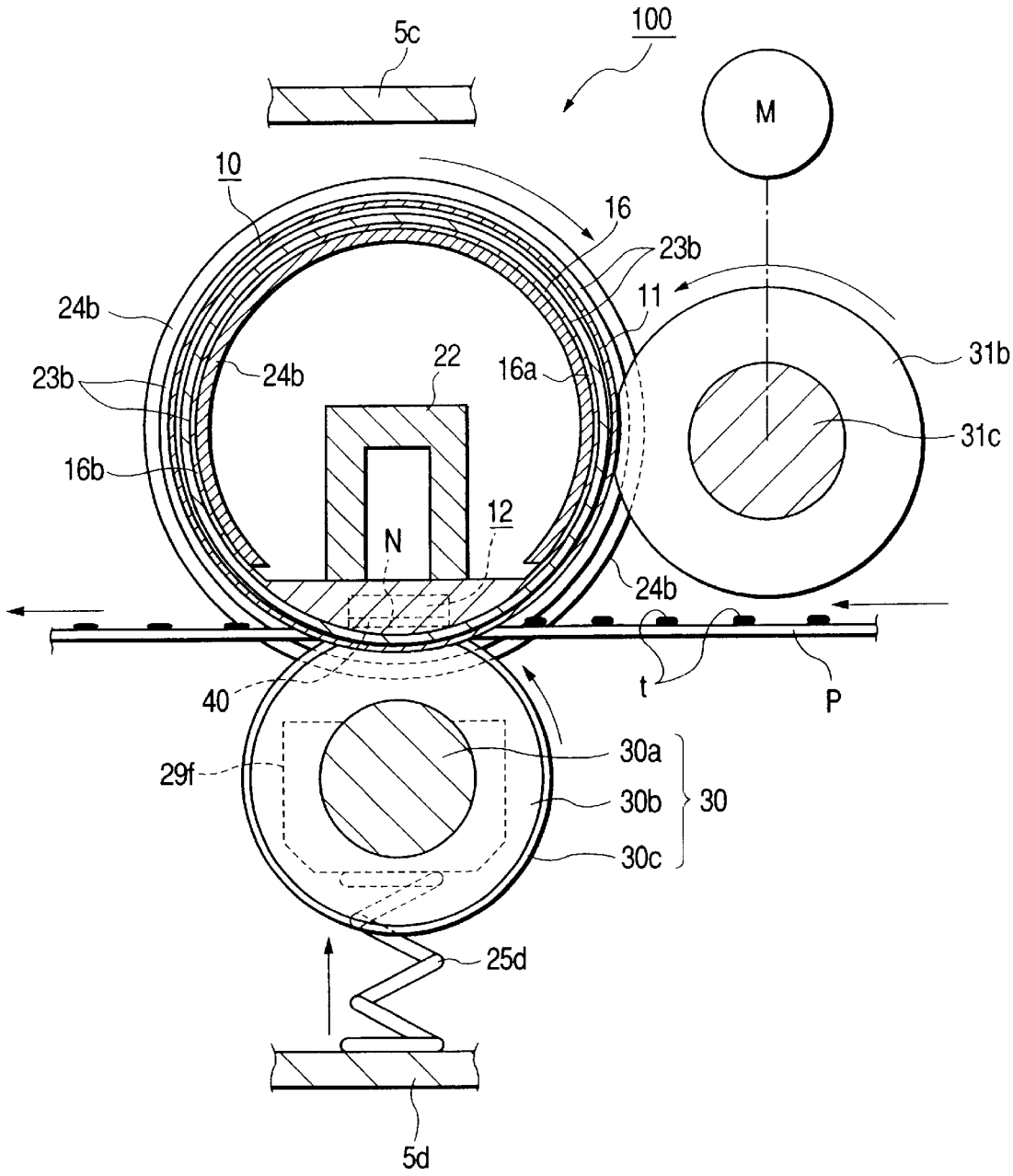
FIG. 14 is a side view of an image heating apparatus preferred as further another embodiment.

FIG. 14 shows the above described embodiment (FIGS. 10 and 11) in which the electromagnetic induction heat generating fixing belt 10 is replaced with a cylindrical or endless heat-resistant fixing belt (film) 11, the magnetic cores 17*a* and 17*b* and the excitation coil 18 used as the magnetic field producing means are omitted and a ceramic heater 12 is disposed instead as a heating body on a bottom surface portion of a belt guide member 16 corresponding to the fixing nip portion N. In other respects, a configuration of the embodiment shown in FIG. 14 is similar to that of the above described embodiment and will not be described once again.

On the basis of a print start signal, rotations of the pressure roller 30 and the driving rotating members 31*a*, 31*b* (in case of the apparatus shown in FIG. 13) or the driving rotating members 31*a* and 31*b* (in case of the apparatus shown in FIG. 14) are started, and heat-up of the ceramic heater 12 is started. In a condition where a rotating circumferential speed of the fixing belt 11 becomes stationary and a temperature of the ceramic heater 12 is raised as predetermined, a recording material P carrying a toner image t as a material to be heated is introduced between the fixing belt 11 and the pressure roller 30 in the fixing nip portion N, whereby the recording material P is moved and passed together with the fixing belt 11 through the fixing nip portion N while being kept in close contact with an undersurface of the ceramic heater 12 by way of the fixing belt 11 in the fixing nip portion N. At a moving and passing process, heat is imparted from the ceramic heater 12 to the recording material P by way of the fixing belt 11 and the toner image t is heated and fixed to a surface of the recording material P. In other words, the image on the recording material is heated by heat from the belt. After passing through the fixing nip portion N, the recording material P is separated from a surface of the fixing belt 11, thereafter being carried.

In order to reduce a heat capacity of the fixing belt 11 and improve a quick start property, usable as the fixing belt 11 is a heat-resistant belt composed of a single layer of PTFE, PFA or FEP whose belt film thickness is not more than 100 $\mu$m, preferably not more than 50 $\mu$m and not less than 20 $\mu$m or a composite layers of polyimide, polyimideamide, PEEK, PES or PPS coated with PTFE, PFA or FEP over an outer circumferential surface.

The ceramic heater 12 used as the heating body is a linear heating body which is elongated in a direction perpendicular to a moving direction of the fixing belt 11 and recording material P and has a small heat capacity. The ceramic heater 12 used in the embodiment has a basic configuration consisting of a heater substrate 12*a* which is made of aluminium nitride (AlN), a heat generating layer 12*b* which is disposed on a surface of the heater substrate 12*a* in a longitudinal direction of the heater substrate 12*a*, for example, a heat generating layer 12*b* which is made, for example, of an electric resistor material such as Ag/Pd (silver/palladium) approximately 10 $\mu$m by 1 to 5 mm wide and is formed by screen printing, and a protective layer 12*c* of glass or fluororesin which is disposed on the heat generating layer 12*b*. A sliding member 40 is disposed on a side of a rear surface on the heater substrate 12*a* of the ceramic heater 12 on a side opposite to a front surface on which the heat generating layer 12*b* and the protective layer 12*c* are disposed.

When power is supplied between both ends of the heat generating layer 12*b* of the above described ceramic heater 12, the heat generating layer 12*b* generates heat, thereby raising a temperature of the heater 12 rapidly. The heater temperature is detected with a temperature sensor (not shown), and is controlled and managed so as to be kept at a predetermined temperature with a control circuit (not shown) which controls power supply to the heat generating layer 12*b*.

The above described ceramic heater 12 is fixed and supported by inserting the heater with the protective layer 12*c* set upwardly into a groove which is formed around a center of a bottom surface of the belt guide member 16 in a longitudinal direction of the guide.

By replacing the ceramic heater 12 used as the heating body with an electromagnetic heat generating member such as an iron plate and disposing an excitation coil and magnetic cores are disposed as magnetic field producing means inside the belt guide member 16 so that the electromagnetic heat generating member such as the iron plate generates electromagnetic induction heat as a heating body, the fixing apparatus preferred as the embodiment can be configured as a fixing apparatus in which heat generated by the electromagnetic induction heat generating member is imparted to a recording material P by way of the fixing belt 11 in the fixing nip portion N.

Like the fixing apparatus preferred as the above described embodiment, the fixing apparatus preferred as this embodiment is also capable of preventing the fixing belt 11 from slipping and carrying the recording material P nearly at a constant speed.

The fixing apparatus (FIGS. 1 through 3) preferred as the above described embodiment can have a configuration in which the pressure roller 30 is loosely fitted over the core metal 30*a* so that the pressure roller 30 is rotated by following to the rotation of the fixing belt 10 and the fixing belt 10 is rotated by rotatingly driving the driving rotating members 31*a* and 31*b*.

In a case where monochromatic image of a single path multicolor image is to be heated and fixed, the elastic layer 2 may be omitted from the electromagnetic induction heat generating fixing belt 10. The heat generating layer 1 can be made of resin fixed with a metal filler. The ceramic heater may be a single layer member composed only of a heating layer.

Furthermore, the pressure roller 30 is not limited to a roller body but may be another type member such as a rotating belt.

In order to supply a heat energy to a recording material also from a side of the pressure roller 30, the fixing apparatus can have a configuration in which heat generating means such as an electromagnetic induction heat generating member is disposed also on a side of the pressure roller 30 for heating and controlling at a predetermined temperature.

Furthermore, the heating apparatus according to the present invention is usable not only as the image heating fixing apparatus preferred as the embodiment but also widely as mean and a apparatus which for heat treatment of materials to be heated such as an image heating apparatus which improves surface properties such as gloss by heating a recording material carrying an image, an image heating apparatus for temporal fixing, a heating drying apparatus for a material to be heated or a heating laminating apparatus.

While the embodiments of the present invention have been described above, the present invention is not limited by the above described embodiments in any way and all possible modifications are permitted within a technical idea of the present invention.

What is claimed is:

1. An image heating apparatus, comprising:

a movable endless belt;

a support member for supporting said belt at an inside of said belt;

a back up member forming a nip portion with said support member via said belt;

wherein said belt slides relative to said support member and an image on a recording material is heated with heat from said belt;

a holding member for holding said belt at an inside of said belt and being movable together with said belt; and a driving member opposing to said holding member via said belt and driving said belt, wherein said belt has a center area and an end portion area located outside of the center area in a longitudinal direction on a nip portion, and said holding member and said driving member are provided in the end portion area.

2. An image heating apparatus according to claim 1, wherein the recording material bearing an image is sandwiched and conveyed with said nip.

3. An image heating apparatus according to claim 1, wherein said driving member and said back up member are rollers respectively and shafts of said rollers are common.

4. An image heating apparatus according to claim 3, wherein said driving member is separated from said back up member.

5. An image heating apparatus according to claim 1, wherein a force of said driving member for conveying said belt is greater than a force of said back up member for conveying said belt.

6. An image heating apparatus according to claim 1, wherein a frictional force between said driving member and said belt is greater than a frictional force between said back up member and said belt.

7. An image heating apparatus according to claim 1, wherein each of said driving member and said back up member has an elastic layer, and a thickness of the elastic layer of said driving member is smaller than a thickness of elastic layer of said back up member.

8. An image heating apparatus according to claim 1, wherein said holding member is supported by said support member, and a frictional force between said holding member and said support member is smaller than a frictional force between said belt and said support member.

9. An image heating apparatus according to claim 1, wherein a surface roughness at a portion of said belt opposed to said driving member is greater than a surface roughness at a portion of said belt opposed to said back up member.

10. An image heating apparatus according to claim 1, wherein said holding member moves at a speed which is substantially the same as that of said belt.

11. An image heating apparatus according to claim 1, wherein said belt has a surface releasing layer at a portion other than a portion opposing said driving member.

12. An image heating apparatus according to claim 1, further comprising a regulating member for regulating deviation of said belt in a direction perpendicular to a moving direction of said belt, wherein said holding member abuts said regulating member.

13. An image heating apparatus according to claim 1, wherein said driving member is separated from said nip with respect to a moving direction of said belt.

14. An image heating apparatus according to claim 1, further comprising magnetic flux producing means, wherein an eddy current is produced at said belt by a magnetic flux produced by said magnetic flux producing means, said belt generates heat by the eddy current and the image on the recording material is heated with the generated heat.

15. An image heating apparatus according to claim 14, wherein said belt has a metal layer at a portion in contact with said support member.

16. An image heating apparatus according to claim 1, further comprising a heating body generating heat by energization, wherein the image on the recording material is heated with heat from said heating body.

17. An image heating apparatus according to claim 16, wherein said heating body is attached to said support member.

18. An image heating apparatus according to claim 1, wherein said support member has a sliding member at a port ion being in contact with said belt.

* * * * *

UNITED STATES PATENT AND TRADEMARK OFFICE

CERTIFICATE OF CORRECTION

PATENT NO. : 6,597,888 B1
DATED : July 22, 2003
INVENTOR(S) : Atsuyoshi Abe et al.

It is certified that error appears in the above-identified patent and that said Letters Patent is hereby corrected as shown below:

Title page, Item [54] and Column 1, line 2,
Title, "A" should read -- AND --.

Column 5,
Line 51, "an" should read -- a --.
Line 52, "an" (both occurrences) should read -- a --.

Column 6,
Line 7, "an" should read -- a --.

Column 14,
Lines 14 and 22, "ununiformity." should read -- nonuniformity. --.

Column 22,
Line 15, "port" should read -- portion --.
Line 16, "ion" should be deleted.

Signed and Sealed this

Thirtieth Day of December, 2003

JAMES E. ROGAN
*Director of the United States Patent and Trademark Office*